US005924907A

United States Patent [19]

Tobin

[11] Patent Number: 5,924,907

[45] Date of Patent: Jul. 20, 1999

[54] MARBLE TRACK CONSTRUCTION TOY

[76] Inventor: Adam Zev Tobin, 79 Belvedere, #17, San Rafael, Calif. 94901

[21] Appl. No.: 08/767,537

[22] Filed: Dec. 16, 1996

Related U.S. Application Data

[60] Provisional application No. 60/011,751, Dec. 19, 1995.

[51] Int. Cl.[6] ..... A63H 29/08; A63H 33/06; A63H 33/00

[52] U.S. Cl. ..... 446/168; 446/118; 446/489

[58] Field of Search ..... 446/168, 169, 446/170, 171, 172, 173, 174, 89, 117, 118, 489; 463/69; 273/FOR 86 C

[56] References Cited

U.S. PATENT DOCUMENTS

| | | | |
|---|---|---|---|
| 1,252,616 | 1/1918 | Reif | 446/168 X |
| 1,450,375 | 4/1923 | Kehl | 446/166 |
| 3,438,633 | 4/1969 | Thomas | 273/120 |
| 3,689,074 | 9/1972 | Benton et al. . | |
| 3,696,549 | 10/1972 | Zilius | 446/169 |
| 3,800,443 | 4/1974 | O'Connell et al. . | |
| 3,801,094 | 4/1974 | Treaster . | |
| 4,037,355 | 7/1977 | Street . | |
| 4,171,090 | 10/1979 | Eisenburg | 446/168 X |
| 5,007,876 | 4/1991 | Klitsner . | |
| 5,056,789 | 10/1991 | Talbot . | |
| 5,314,367 | 5/1994 | Schaefer . | |
| 5,451,177 | 9/1995 | Gilman | 446/89 X |

FOREIGN PATENT DOCUMENTS

| | | | |
|---|---|---|---|
| 47513 | 8/1920 | Sweden | 446/170 |
| 2 147 633 | 5/1985 | United Kingdom | 446/118 |

OTHER PUBLICATIONS

Tube Trax packaging, Battat Inc., Plattsburgh, New York, 1993 (2 sheets).

Blocks and Marbles packaging, Blocks and Marbles Brand Toys, Inc, Crawfordsville, Indiana, 1987 (1 sheet).

*Primary Examiner*—Robert A. Hafer
*Assistant Examiner*—D. Neal Muir
*Attorney, Agent, or Firm*—Laurence J. Shaw

[57] ABSTRACT

A marble track is constructed from cubes, base blocks, tower dowels, track dowels and rubber bands. Each cube has four vertically oriented tower bores, through-bores of approximately the width of the tower dowels, adjacent and parallel to the four vertical edges of the cube. Each base block has four vertically oriented tower bores with the same spacing as the tower bores in the cube. Cubes may be positioned on tower dowels extending vertically from a base block, and the position of a cube may be stabilized by a rubber band around the tower dowels just below the cube. A channel in each cube (except the "end cubes") permits a marble to pass through the cube. A channel may be bifurcated, and may have entrances/exits to any combination of the six faces of a cube. Track dowels may be inserted in track bores below each side channel entrance/exit to permit the marble to roll out of the channel and onto the track dowels. To facilitate the capture of a marble falling into a top entrance hole of a channel, the top hole may have a counterbore. Optimal dimensions of the components are related to the diameters of the marble and the dowels, and the side length of the cubes.

37 Claims, 16 Drawing Sheets

Fig. 2A
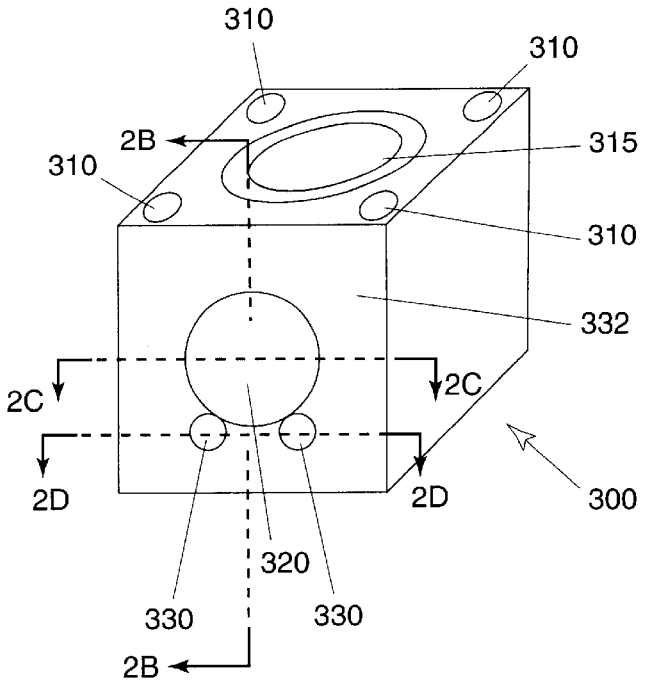
Fig. 2C
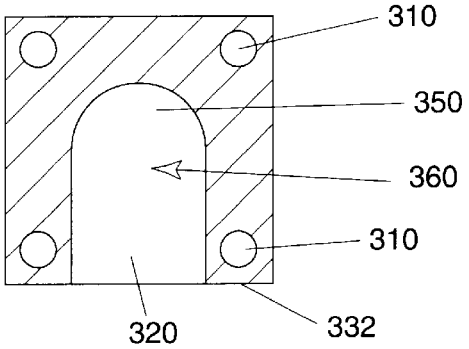
Fig. 2B
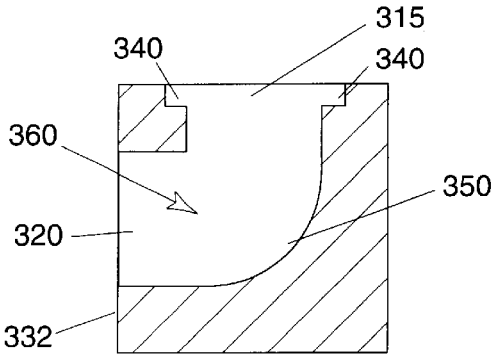
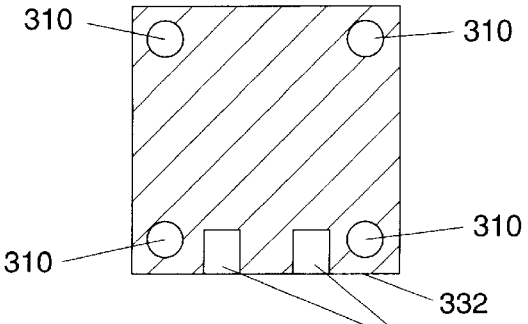
Fig. 2D

Fig. 4A
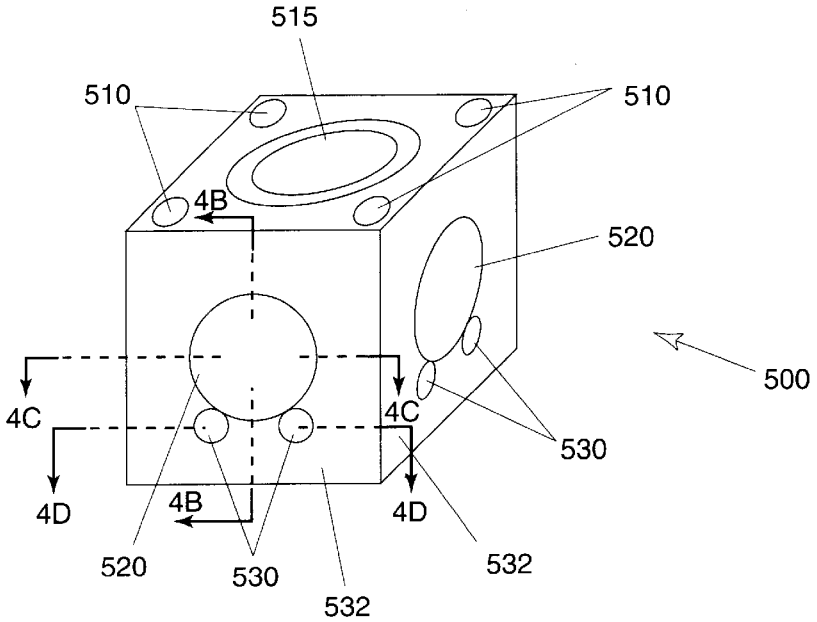
Fig. 4C
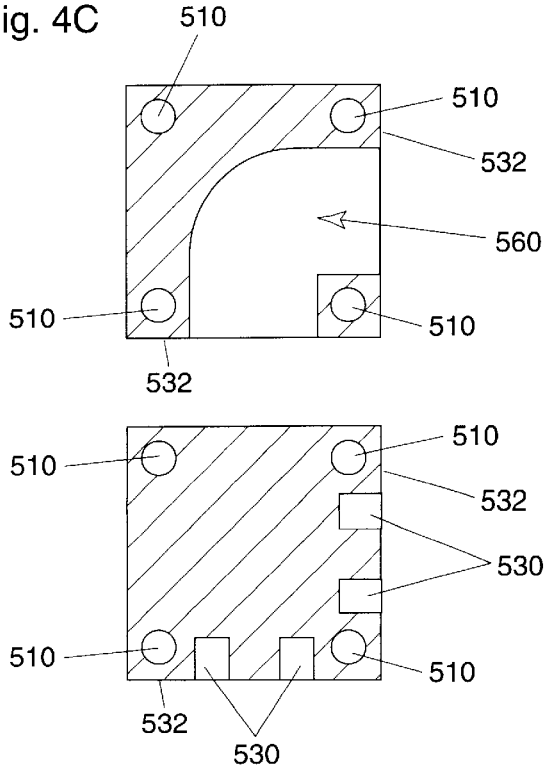
Fig. 4D
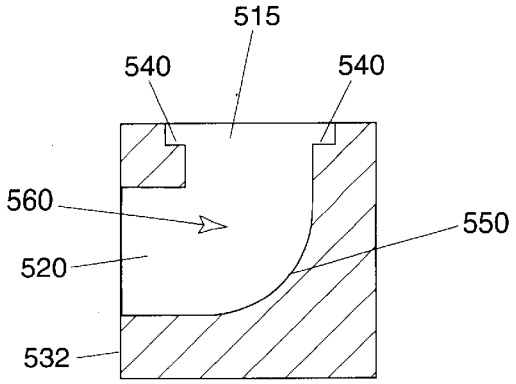
Fig. 4B

Fig. 5A
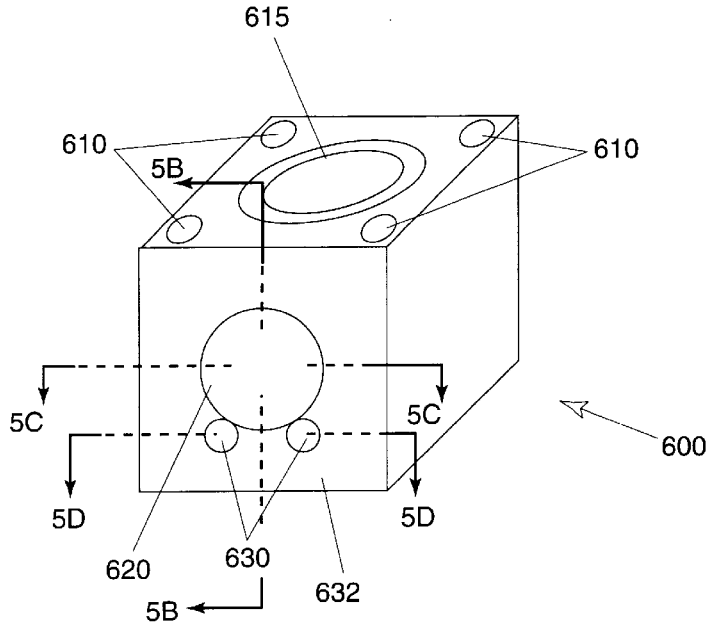
Fig. 5C
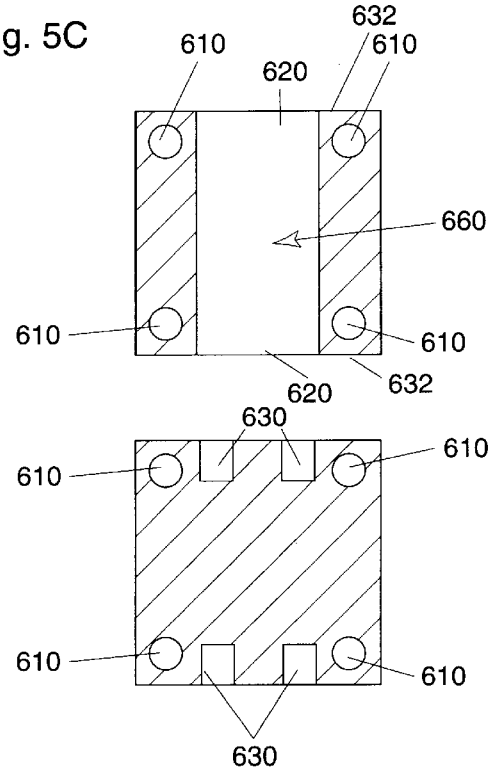
Fig. 5D
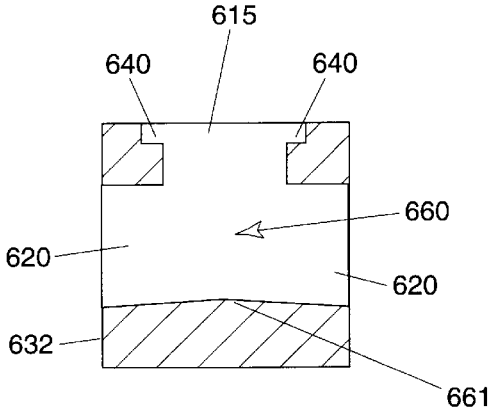
Fig. 5B

Fig. 6A
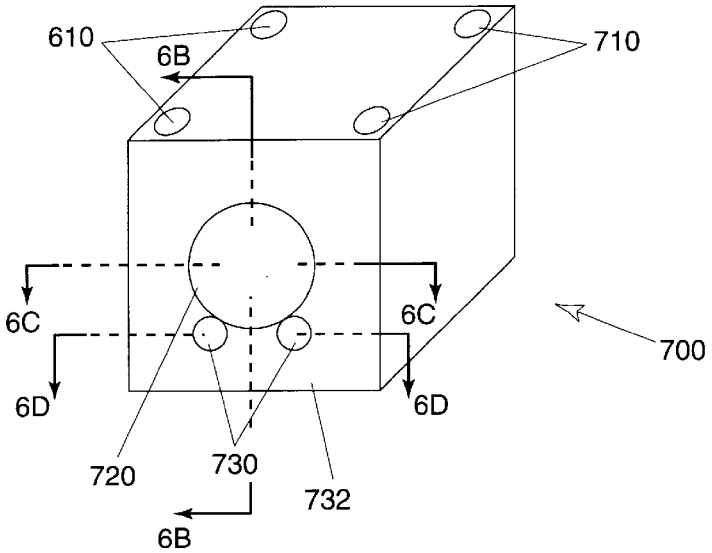
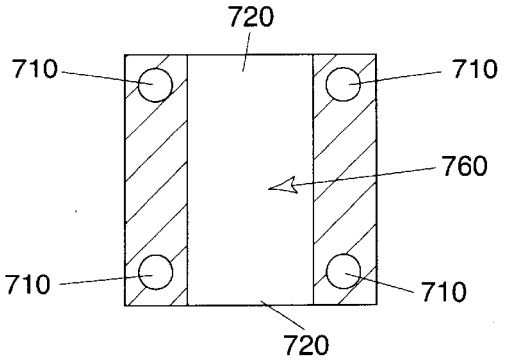
Fig. 6C
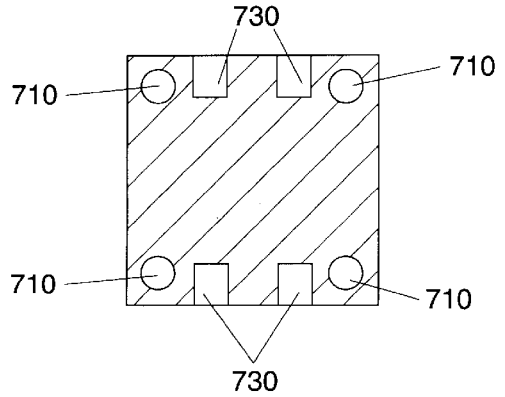
Fig. 6D
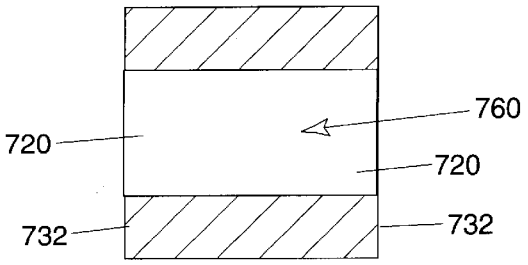
Fig. 6B

Fig. 7A
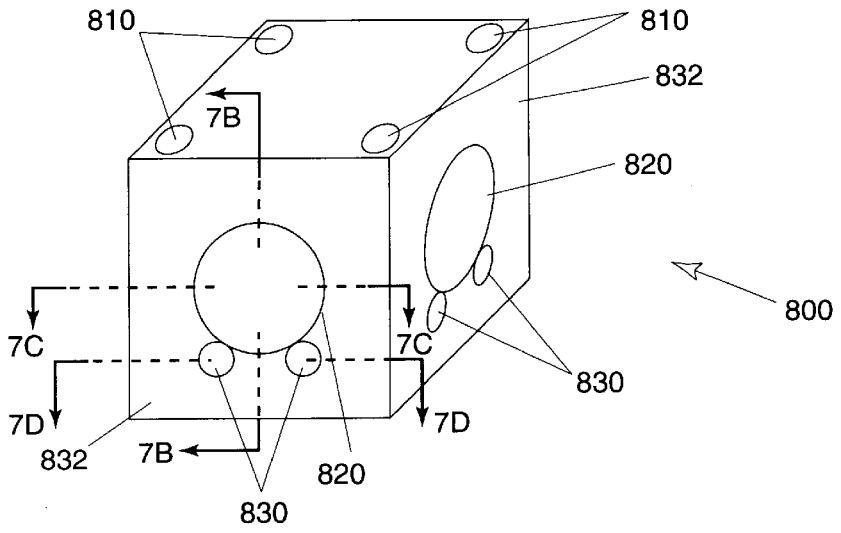
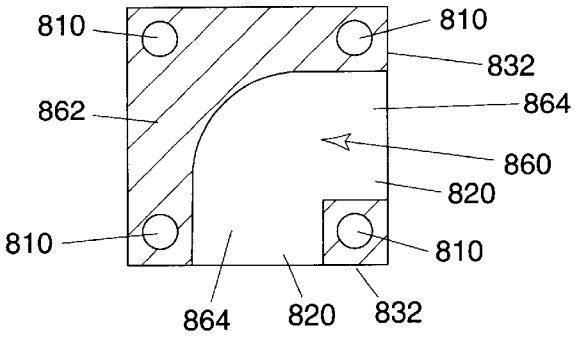
Fig. 7C
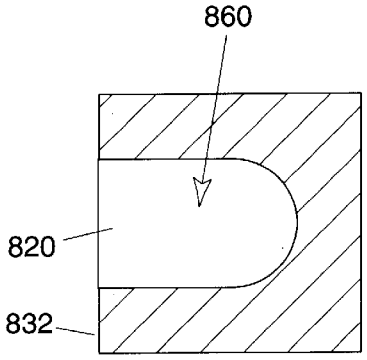
Fig. 7B
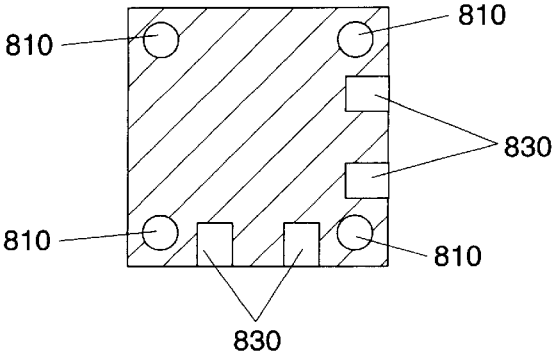
Fig. 7D

Fig. 8C
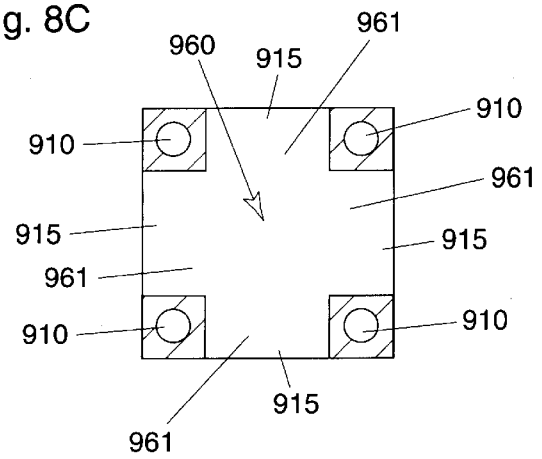
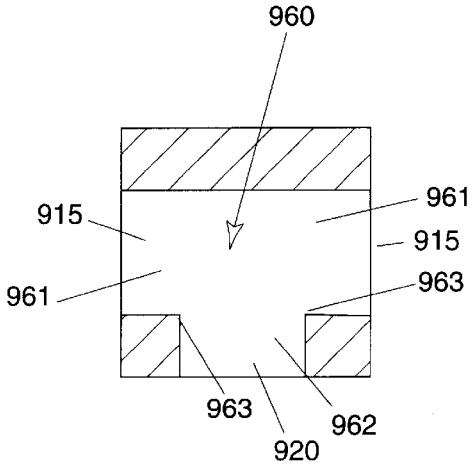
Fig. 8B
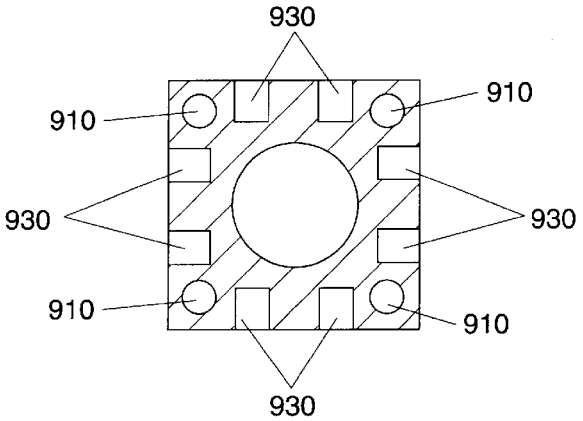
Fig. 8D
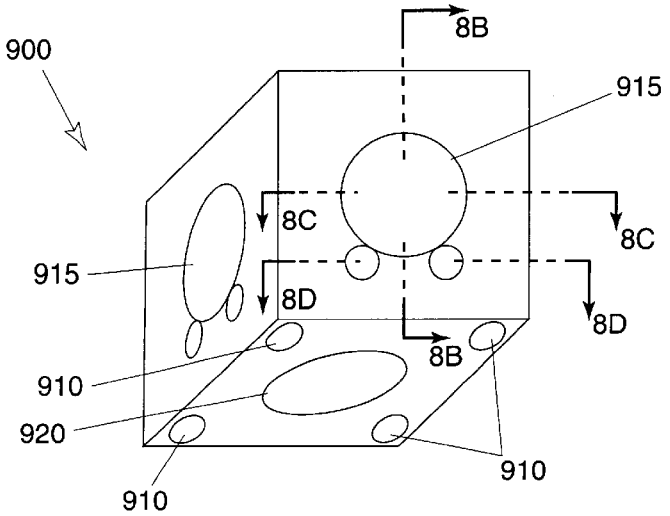
Fig. 8A

Fig. 9A
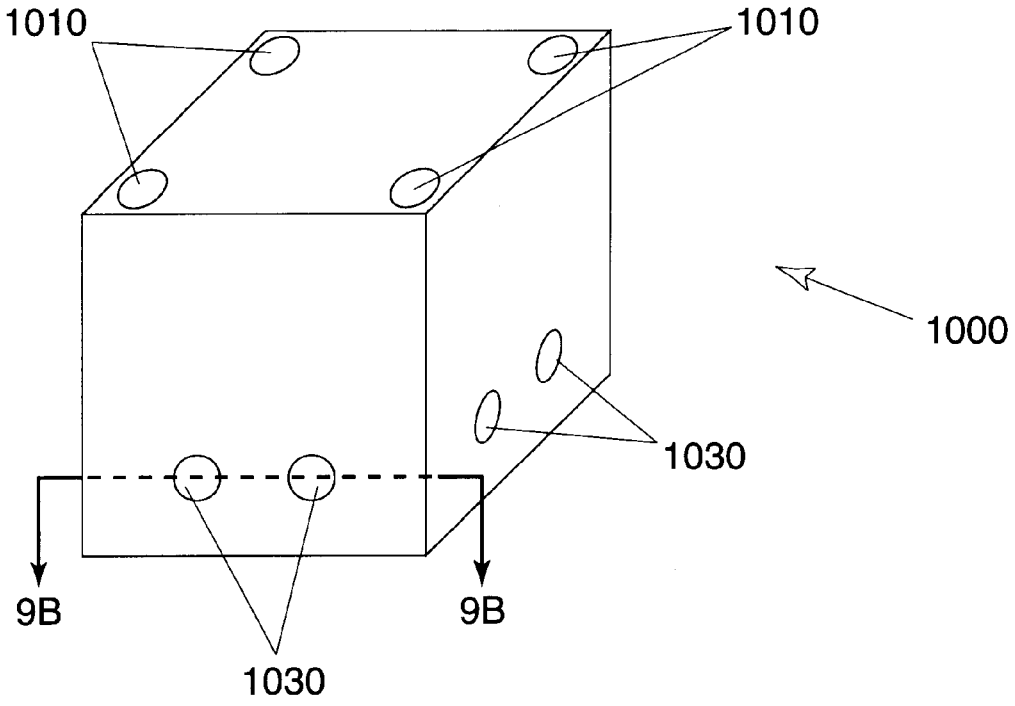
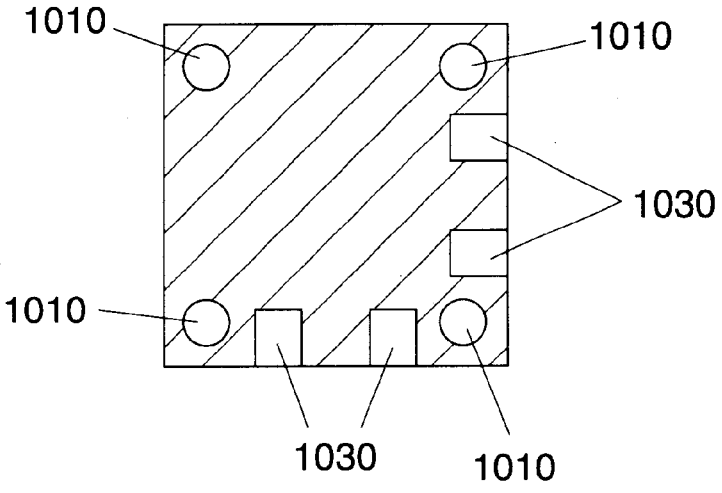
Fig. 9B

Fig. 10A
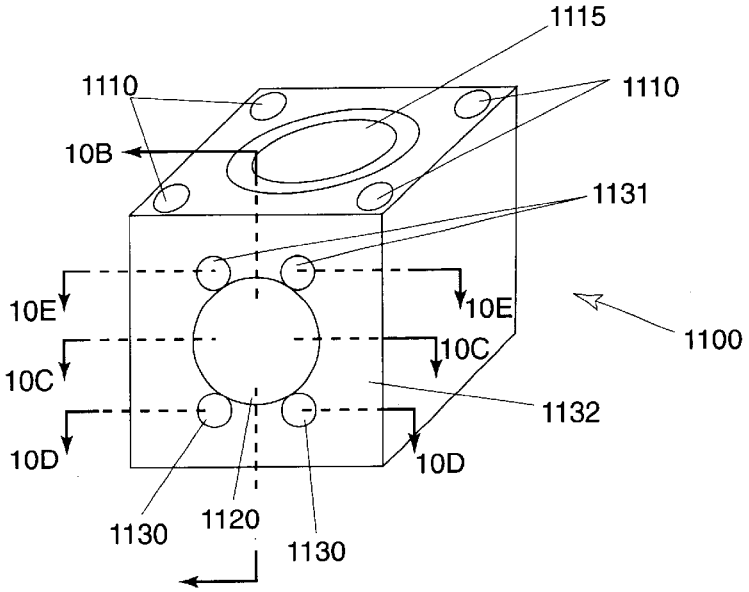
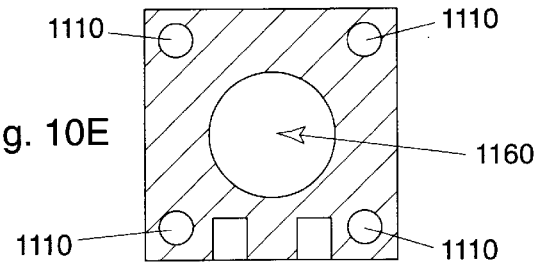
Fig. 10E
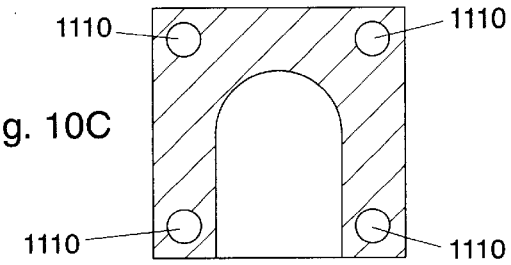
Fig. 10C
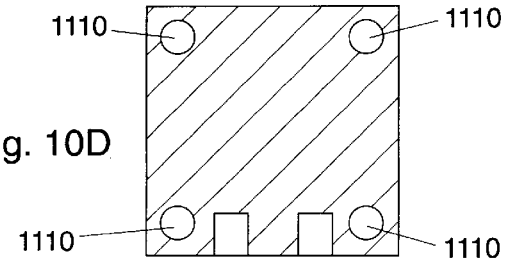
Fig. 10D
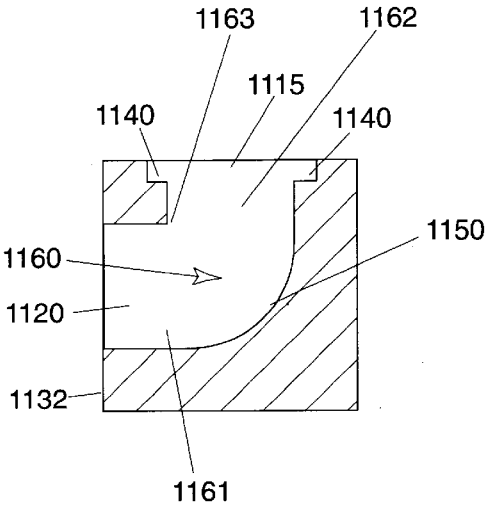
Fig. 10B Fig. 14A
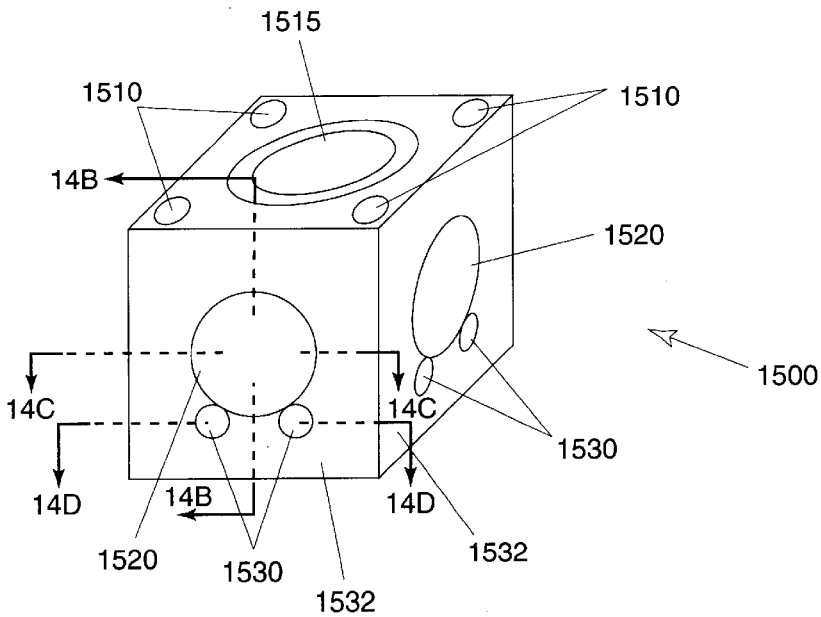
Fig. 14C
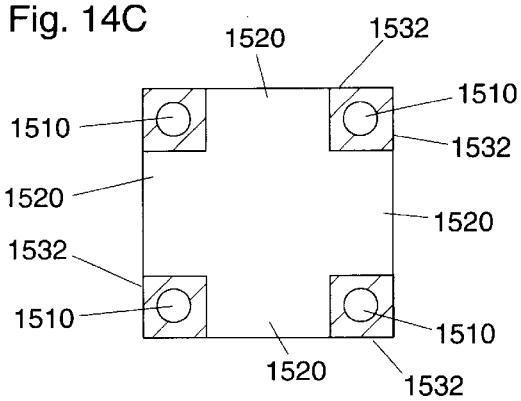
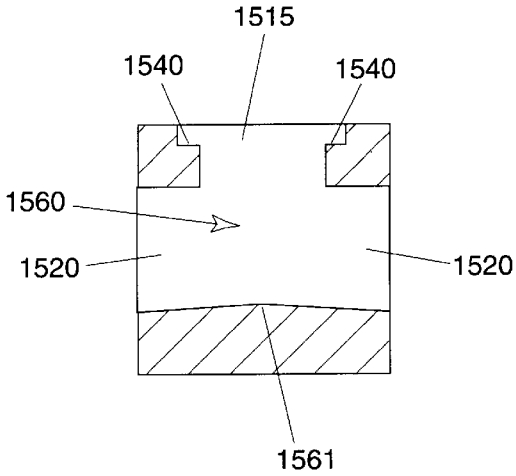
Fig. 14B
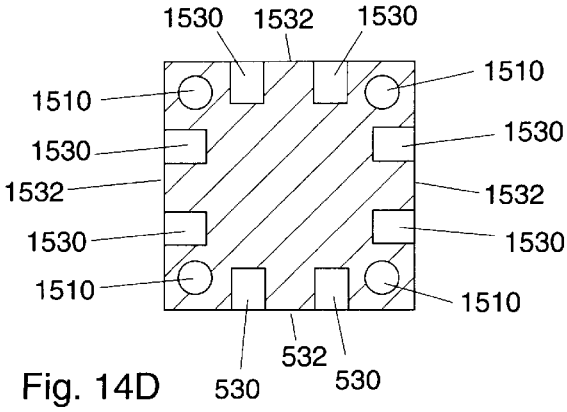
Fig. 14D Fig. 15A
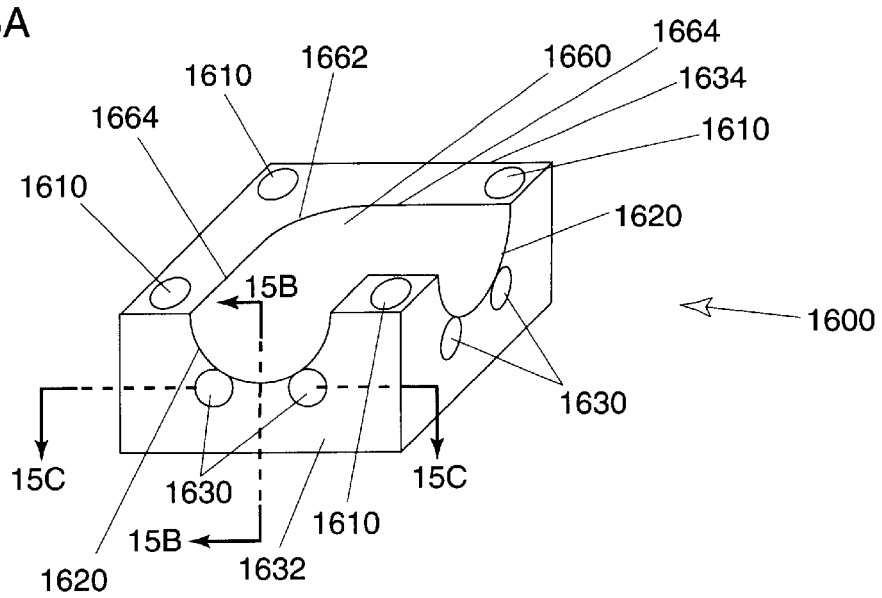
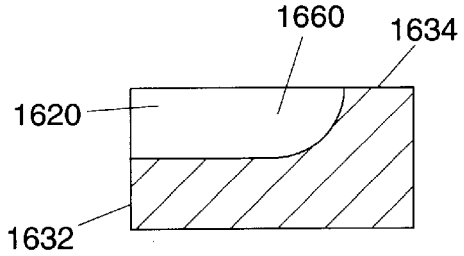
Fig. 15B
Fig. 15C
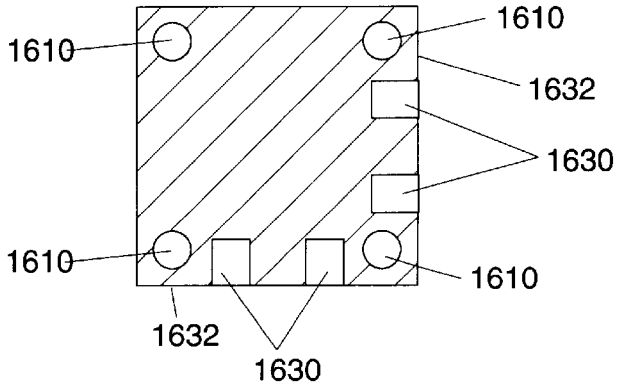

MARBLE TRACK CONSTRUCTION TOY

RELATED APPLICATIONS

The present regular patent application under 35 U.S.C. § 111(a) is based on the provisional application for Marble Track Construction Toy by Adam Zev Tobin, filed on Dec. 19, 1995 under 35 U.S.C. § 111(b).

BACKGROUND OF THE INVENTION

Field of the Invention

The present invention relates generally to construction toys and toys involving the rolling of marbles and the like, and more particularly to toys where a track is constructed for a marble to roll down.

One marble track construction toy currently available to the public is Blocks and Marbles™, manufactured by Blocks and Marbles Brand Toys Inc., of Crawfordsville, Ind. The components of Blocks and Marbles include cubes which have an unbifurcated internal marble channel with a right-angle turn therethrough, and rectangular blocks which have an exposed trough for the marble to roll along. The cubes are constructed to be used with one section of the channel oriented vertically: the opening at the top of the cube is widened to facilitate capture of a falling marble, and the interior of the channel is not sufficiently smooth to allow a marble to roll through if the channel is oriented horizontally. A marble track is constructed using this construction toy by stacking the cubes and rectangular blocks such that a marble dropped into the interior channel of a cube near the top of the track or rolled along a trough in a rectangular block near the top of the track, will pass through a sequence of interior channels and troughs as it descends along the track.

A disadvantage of this construction toy is that cubes and rectangular blocks are to be used to support the cubes and rectangular blocks that form the marble track, thereby limiting the length of the marble track to be considerably less than what might be expected by a purchaser on first inspection. Also, because the cubes and rectangular blocks that form the track are stacked on other cubes and rectangular blocks, only tracks of limited height may be constructed before the track becomes likely to topple. Also, because the marble channels in the cubes are unbifurcated, only unbifurcated track geometries can be constructed. Also, a limited number of track geometries are possible because a marble will generally not roll through a cube if the internal channel is oriented horizontally.

It is therefore a general object of the present invention to provide a construction toy, particularly a toy for construction of a track for a marble to roll down.

It is also an object of the present invention to provide a marble track construction toy with special components, especially low mass components, to support portions of the marble track.

It is another object of the present invention to provide a marble track construction toy where the track is built from modular removably interlocking parts, and can be built relatively high without likelihood of toppling.

It is another object of the present invention to provide a marble track whose size can be extended indefinitely.

It is another object of the present invention to provide a marble track construction toy that allows bifurcated tracks to be built.

It is another object of the present invention to provide a marble track construction toy with a component that causes the marble to perform a horizontal right-angle turn.

More particularly, it is an object of the present invention is to provide a toy comprised of dowels and cubes for construction of a track for a marble to roll down.

Further objects and advantages of the present invention will become apparent from a consideration of the drawings and the ensuing detailed description. These various embodiments and their ramifications are addressed in greater detail in the Detailed Description.

BRIEF DESCRIPTION OF DRAWINGS

The accompanying drawings, which are incorporated in and form a part of the present specification, illustrate embodiments of the invention and together with the Detailed Description serve to explain the principles of the invention:

FIG. 2A is a perspective view of a top-to-side cube, i.e., a cube with a channel from the top surface to a side surface. FIG. 2B shows a vertical cross section of the cube. FIG. 2C shows a horizontal cross section through the exit hole of the cube. FIG. 2D shows a horizontal cross section through the track bores of the cube.

FIG. 4A is a perspective view of a top-to-two-adjacent-sides cube, i.e., a cube with a bifurcated channel from the top surface to two adjacent side surfaces. FIG. 4B shows a vertical cross section of the cube. FIG. 4C shows a horizontal cross section through the exit holes of the cube. FIG. 4D shows a horizontal cross section through the track bores of the cube.

FIG. 5A is a perspective view of a top-to-two-opposite-sides cube, i.e., a cube with a bifurcated channel from the top surface to two opposite side surfaces. FIG. 5B shows a vertical cross section of the cube. FIG. 5C shows a horizontal cross section through the exit holes of the cube. FIG. 5D shows a horizontal cross section through the track bores of the cube.

FIG. 6A is a perspective view of a side-to-opposite-side cube, i.e., a cube with a channel from the one side surface to the opposite side surface. FIG. 6B shows a vertical cross section of the cube. FIG. 6C shows a horizontal cross section through the side holes of the cube. FIG. 6D shows a horizontal cross section through the track bores of the cube.

FIG. 7A is a perspective view of a side-to-adjacent-side cube, i.e., a cube with a channel from one side surface to an adjacent side surface. FIG. 7B shows a vertical cross section of the cube. FIG. 7C shows a horizontal cross section through the side holes of the cube. FIG. 7D shows a horizontal cross section through the track bores of the cube.

FIG. 8A is a perspective view of a four-sides-to-bottom cube, i.e., a cube with a bifurcated channel from the four side surfaces to the bottom surface. FIG. 8B shows a vertical cross section of the cube. FIG. 8C shows a horizontal cross section through the side holes of the cube. FIG. 8D shows a horizontal cross section through the track bores of the cube.

FIG. 9A is a perspective view of an end cube, i.e., a cube with no channel. FIG. 9B shows a horizontal cross section through the track bores of the cube.

FIG. 10A is a perspective view of a top-to-side/side-to-bottom cube, i.e., a cube which can be used as a top-to-side-cube or a side-to-bottom cube. FIG. 10B shows a vertical cross section of the cube. FIG. 10C shows a horizontal cross section through the side hole of the cube. FIG. 10D shows a horizontal cross section through the pair of track bores farthest from the top/bottom hole. FIG. 10D shows a horizontal cross section through the pair of track bores nearest the top/bottom hole.

FIG. 14A is a perspective view of a top-to-four-sides cube, i.e., a cube with a bifurcated channel from the top surface to the four side surfaces. FIG. 14B shows a vertical cross section of the cube. FIG. 14C shows a horizontal cross section through the exit holes of the cube. FIG. 14D shows a horizontal cross section through the track bores of the cube.

FIG. 15A is a perspective view of a side-to-adjacent-side half cube, i.e., a cube with a groove from one side surface to an adjacent side surface. FIG. 7B shows a vertical cross section of the half cube. FIG. 7C shows a horizontal cross section through the track bores of the half cube.

DETAILED DESCRIPTION

Figure 1:
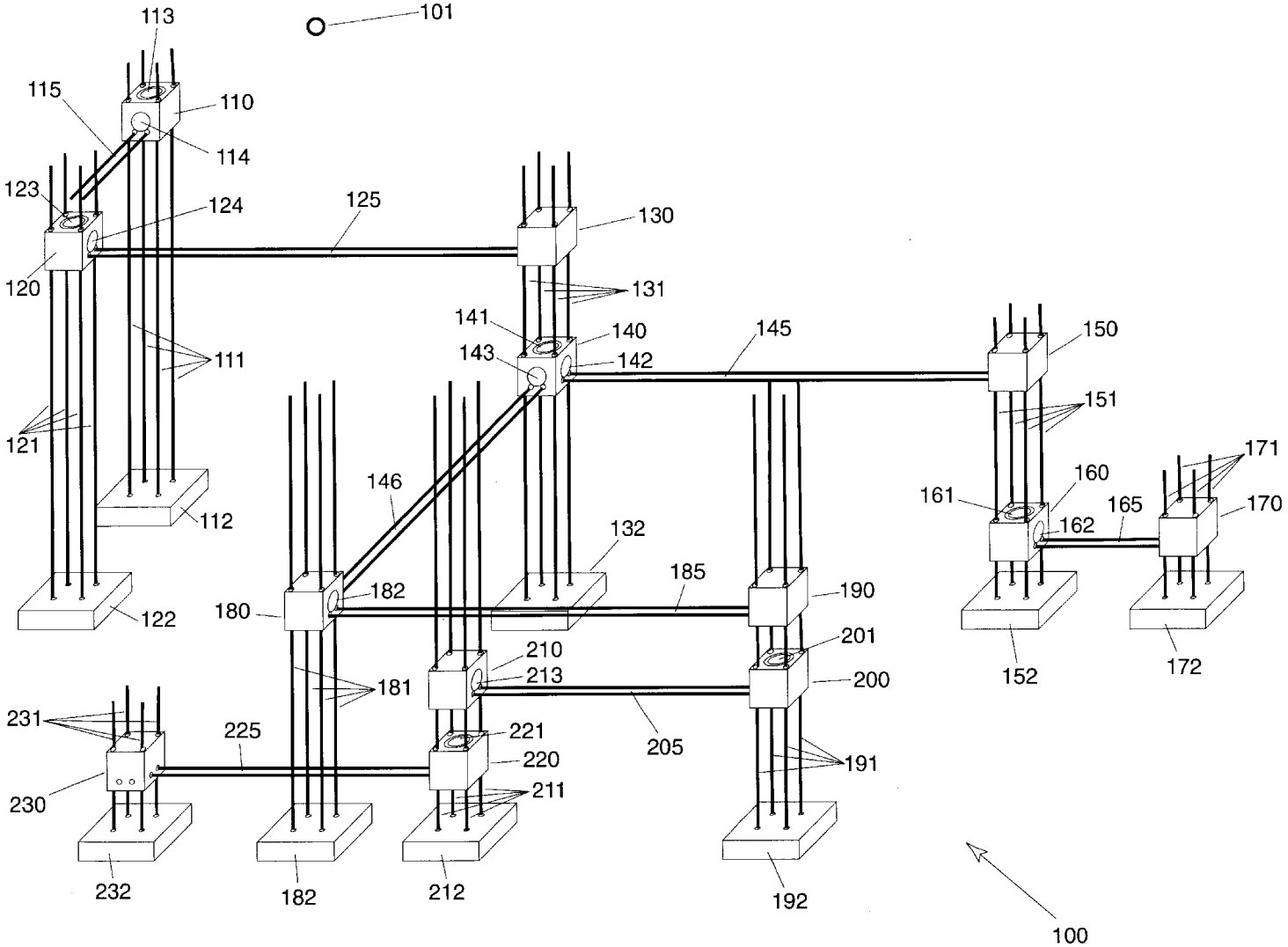
FIG. 1 is a perspective view of a system of tracks constructed from dowels cubes, and base blocks according to the present invention.

An example of a marble track 100 constructed from the construction toy of the present invention is shown in perspective in FIG. 1. The marble track 100 consists of tower dowels 111, 121, 131, 151, 171, 181, 191, 211 and 231 (collectively having the reference numeral 111+), base blocks 112, 122, 132, 152, 172, 182, 192, 212 and 232 (collectively having the reference numeral 112+), pairs of track dowels 115, 125, 145, 146, 165, 185, 205 and 225 (collectively having the reference numeral 115+), and cubes 110, 120, 130, 140, 150, 160, 170, 180, 190, 200, 210, 220 and 230 (collectively having the reference numeral 110+). (In the present specification when elements are referred to collectively or when a general type of element is referred to followed by the reference numeral of a particular element of that type, the reference numeral will have an appended plus sign.)

In particular: cubes 110, 120, 160, 200 and 220 are top-to-side cubes (each top-to-side cube has an interior channel from the top surface to a side surface); cubes 130, 150, 190 and 210 are side-to-bottom cubes (each side-to-bottom cube has an interior channel from a side surface to the bottom surface); cube 140 is a top-to-two-adjacent-sides cube (it has a bifurcated interior channel from the top surface to two side surfaces); cube 180 is a side-to-adjacent-side cube (side-to-adjacent-side cubes have an interior channel from one side surface to an adjacent side surface); and cubes 170 and 230 are end cubes (they have no channels). The interior channels of the cubes 110+ have a width somewhat greater than the diameter of the marble 101, so the marble 101 can roll through the interior channels.

Each cube 110+ has four vertical bores near each of the four vertical edges (these vertical bores are only visible in FIG. 1 as the points where the tower dowels 111+ extend from the cubes 110+), through which pass four tower dowels 111+. The width of the vertical bores is slightly larger than the width of the tower dowels 111+, as discussed in detail below. Around the tower dowels 111+ below each cube 110+ is a rubber band (not visible in FIG. 1) to prevent the cube 110+ from sliding down the tower dowels 111+. The base blocks 112+ each have four tower bores with the same spacing as the bores in the cubes 110+, and each set of four tower dowels 111+ are seated in a base block 112+. In the preferred embodiment the tower bores in the base blocks 112+ only extend part way into the base blocks 112+. Directly below each entrance or exit hole in the cubes 110+ are two track bores separated by a distance somewhat less than the diameter of the marble 101 (these track bores are only visible in FIG. 1 as the points where the track dowels 115+ meet the cubes 110+). The track bores have approximately the same width as the track dowels 115+, so when a track dowel 115+ is inserted into a track bore it will be held in place by friction between the bore and the dowel 115+. The track bores are substantially tangent with the side holes of the cubes 110+ so that the marble 101 can roll smoothly into and out of the side holes. The tower dowels 111+ and the track dowels 115+ come in three lengths: track dowels 125, 145, 146 and 185 and tower dowels 111, 121, 131, 181, 191 and 211 are long; track dowels 205 and 225 and tower dowels 151 are medium; and track dowels 115 and 165 and tower dowels 171 and 231 are short. In the preferred embodiment of the present invention the tower dowels 111+ and the track dowels 115+ are interchangeable, i.e., dowels can be used as track dowels or tower dowels.

In the assembly of FIG. 1, the cube 110+ with the greatest height is the top-to-side cube 113 at the top left in the figure. Play begins when a marble 101 is dropped into the top hole 113 of the top-to-side cube 110 of FIG. 1. (It should be noted that alternatively play may begin with the marble 101 being placed on the track anywhere above the lowest point on the track.) The marble 101 will then roll through an interior channel in the cube 110 (this interior channel and other interior channels mentioned in reference to FIG. 1 are not visible in FIG. 1), and exit from the side exit hole 114. The marble 101 then rolls the length of the short track dowels 115 extending from the cube 110.

Another top-to-side cube 120 is positioned below the free ends of the track dowels 115. If the cube 120 is properly positioned, the marble 101 will fall into the top entrance hole 123 of the cube 120. The marble 101 then rolls through an interior channel in the cube 120 and exits through the side exit hole 124. The side-to-bottom cube 130 at the end of the track dowels 125 extending below the side exit hole 124 is positioned slightly lower than top-to-side cube 120, so the long track dowels 125 have a downward slant, and the marble 101 rolls along the track dowels 125 to the side-to-bottom cube 130.

The marble 101 then rolls through an interior channel in the side-to-bottom cube 130 and falls out of the cube 130 towards the top-to-two-adjacent-sides cube 140 mounted on the same set of long tower dowels 131. The top-to-two-adjacent-sides cube 140 has a top entrance hole 141 connected by an interior bifurcated channel to two side exit holes 142 and 143.

If the marble 101 exits the top-to-two-adjacent-sides cube 140 through the right-hand side exit hole 142, it then rolls along the long track dowels 145 to a side-to-bottom cube 150 (the side and bottom holes are not visible in the side-to-bottom cube 150 of FIG. 1). The marble 101 enters the side hole of the cube 150, passes through the interior channel of the cube 150, exits through the hole at the bottom of the cube 150, and falls towards the top-to-side cube 160 mounted on the same set of medium tower dowels 151. The marble 101 enters the entrance hole 161 at the top of the top-to-side cube 160, passes through the interior channel of the cube 160, exits through the hole 162 in the side of the cube 160, and rolls along the short track dowels 165 extending below the side exit hole 162.

The end cube 170 is mounted on the short tower dowels 171 below the height of the top-to-side cube 160 so that the marble 101 will roll the length of the short track dowels 165 to the end cube 170. The end cube 170 has no interior channel, so the marble 101 collides with the end cube 170 and comes to a stop.

If the marble 101 exits the top-to-two-adjacent-sides cube 140 through the other side exit hole 143 it then rolls along the long track dowels 146 to a side-to-side cube 180 (one side hole is not visible in the side-to-side cube 180). The marble 101 enters a side hole of the cube 180, passes through the interior channel of the cube 180, exits through the other side hole 182 of the cube 180, and rolls along the long track dowels 185 towards a side-to-bottom cube 190 (the side and bottom holes are not visible in the side-to-bottom cube 190 of FIG. 1).

The marble 101 enters the side hole of the side-to-bottom cube 190, passes through an interior channel in the cube 190, exits through the hole at the bottom of the cube 190, and falls towards the top-to-side cube 200 mounted on the same set of long tower dowels 191. The marble 101 then enters the entrance hole 201 at the top of the top-to-side cube 200, passes through an interior channel of the cube 200, exits through a side hole (not visible in FIG. 1) in the cube 200, and rolls along the medium track dowels 205 to a side-to-bottom cube 210. It should be noted that the track dowels 185 connecting the side-to-side cube 180 and the side-to-bottom cube 190 pass through the four tower dowels 211 on which the side-to-bottom cube 210 and the top-to-side cube 220 are mounted.

The marble 101 then enters the side hole 213 of the side-to-bottom cube 210, passes through an interior channel in the cube 210, exits through the hole at the bottom (not visible in FIG. 1), and falls towards the top-to-side cube 220 mounted on the same set of long tower dowels 211. The marble 101 enters the top hole 221 of the top-to-side cube 220, passes through an interior channel of the cube 220, exits through the side hole (not visible in FIG. 1) in the cube 220, and rolls along the medium track dowels 225 to an end cube 230. The track dowels 225 connecting the top-to-side cube 220 and the end cube 230 pass through the four tower dowels 181 supporting the side-to-side cube. The end cube 230 has no interior channel so the marble 101 comes to rest after colliding with the end cube 230.

Figure 12:
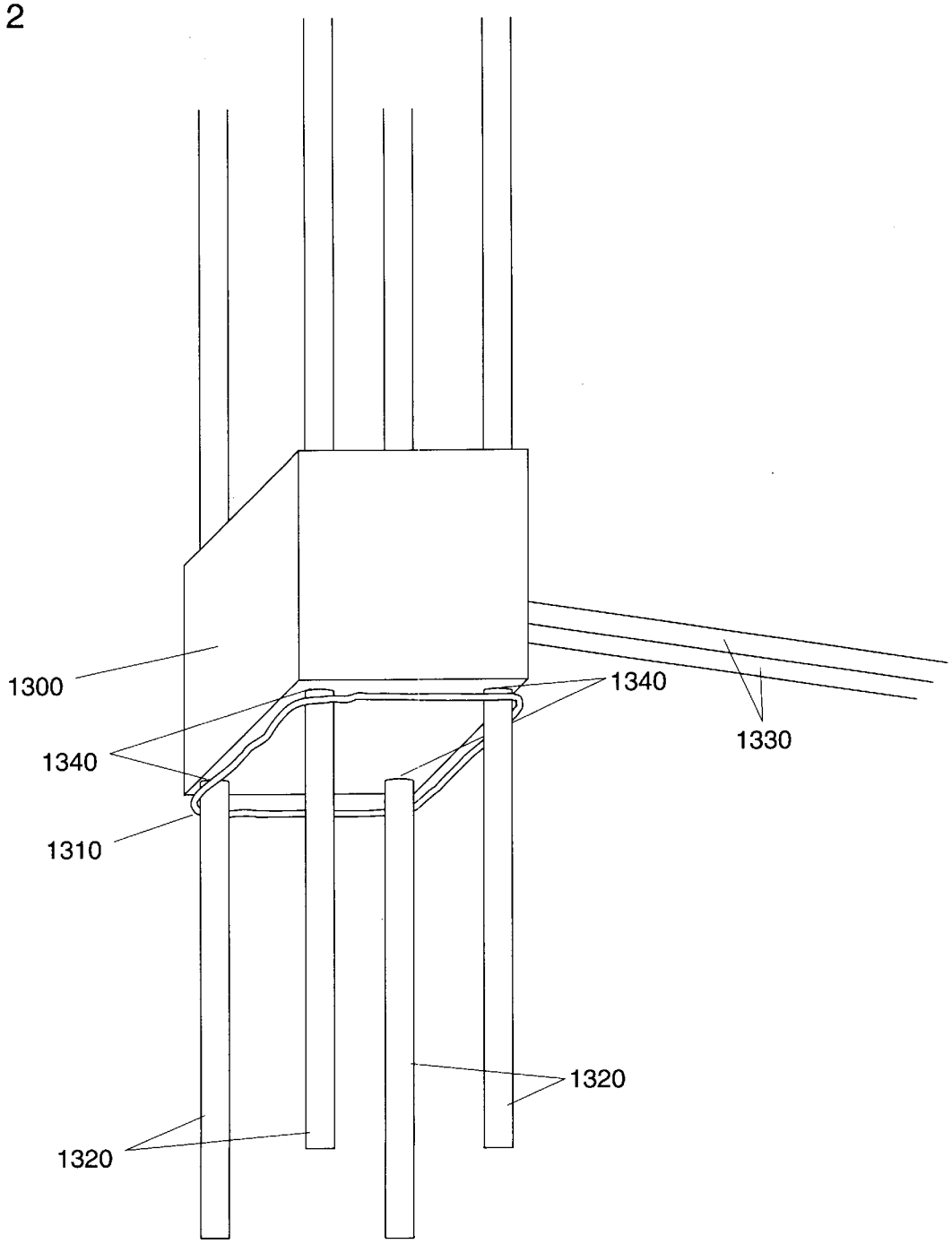
FIG. 12 shows a cube mounted on a set of four tower dowels with a rubber band around the tower dowels below the cube to secure the location of the cube.

As discussed above, each cube 110+ may have a rubber band around the tower dowels 111+ directly below the cube 110+ to prevent the cube 110+ from sliding down the tower dowels 111+. This is particularly useful with cubes 110+ with a top entrance hole and at least one side exit hole, since a marble falling into such a cube 110+ will transfer its vertical momentum to the cube 110+. For instance, FIG. 12 shows a top-to-side cube 1300 which is held in place on a set of tower dowels 1320 passing through the tower bores 1340 by a rubber band 1310 encircling the tower dowels 1320. The cube 1300 has two track dowels 1330 extending from track bores (not visible) located below a side hole (not visible). The cube 1300 also has a top entrance hole (not visible). The rubber band 1310 helps to secure the position of the cube 1300 on the tower dowels 1320 when the marble 101 (not shown in FIG. 12) falls into the top hole and collides with the curved back wall of the channel (see the curved back wall 350 of the channel 360 of the top-to-side cube 300 of FIG. 2B), imparting its momentum to the cube 1300. The cube 1300 is prevented from moving down the tower dowels 1320 because (i) the rubber band 1310 increases the friction between the tower dowels 1320 and the tower bores 1340, and (ii) if the cube 1300 comes into contact with the rubber band 1310, the translational energy of the cube 1300 is converted into compressions and contortions of the rubber of the band 1310. An advantage of using a rubber bands 1310 to increase the friction between the tower dowels 1320 and the tower bores 1340 so as to secure the position of a cube 1310 on the tower dowels 1340, is that the tolerances of the diameters of the tower dowels 1320 and the tower bores 1340 need not be as small as when a rubber band 1310 is not used.

Generally, it is easiest to construct the marble track of the present invention by starting at the end of the track and working backwards since cubes 110+ can be slid onto the tower dowels 111+ from above, but can not be slid on from below unless the tower dowels 111+ are removed from the base block 112+ and then reinserted. For instance for the marble track 100 depicted in FIG. 1, construction may begin by inserting the tower dowels 231 into the base block 232 and sliding the end cube 230 onto the tower dowels 231. The medium track dowels 225 are then inserted into the track bores in the end cube 230. Then the tower dowels 211 are inserted into base block 212, (if rubber bands 1310+ are being used, a rubber band 1310+ is then placed around the tower dowels 211), the top-to-side cube 220 is slid onto the tower dowels 211 to the desired height (and the rubber band 1310+ is rolled up the tower dowels 211 until flush with the top-to-side cube 220), and the side-to-bottom cube 210 is slid onto the tower dowels 211 above the top-to-side cube 220. Then the medium track dowels 225 are inserted into the track bores of the top-to-side cube 220. Alternatively, the medium track dowels 225 could be inserted into the track bores of the end cube 230 and the top-to-side cube 220 after both cubes 230 and 220 are inserted on the tower dowels 231 and 211, respectively.

Similarly, the tower built on base block 192 is most easily constructed from the bottom upwards. The tower dowels 191 are inserted into base block 192, (if rubber bands 1310+ are being used, a rubber band 1310+ is then placed around the tower dowels 191), the top-to-side cube 200 is slid onto the tower dowels 191 (and the rubber band 1310+ is rolled up the tower dowels 191 until flush with the top-to-side cube 200), and the side-to-bottom cube 190 is slid onto the tower dowels 191 above the top-to-side cube 200. Then the medium track dowels 205 are inserted into the track bores of the side-to-bottom cube 210 and the top-to-side cube 200. Alternatively, the medium track dowels 205 can be inserted into the track bores of the side-to-bottom cube 210 prior to the construction of the tower built on base block 192, and when that tower is built the medium track dowels can be inserted into the top-to-side cube 200. Construction of the track continues in a similar manner.

A top-to-side cube 300 is shown in detail in FIGS. 2A–2D. The top-to-side cube 300 has an entrance hole 315 at the top of the cube 300, and an exit hole 320 on one side 332 of the cube 300. As shown in the cross-section of FIG. 2B, the entrance hole 315 is connected to the side exit hole 320 by a channel 360. When the marble 101 is dropped into the entrance hole 315, it will roll through the channel 360, the vertical motion of the marble 101 changing to horizontal motion due to contact with a rounded rear surface 350, and exit from the exit hole 320. As also shown in FIG. 2B, the mouth of the entrance hole 315 is widened by a counterbore 340 to create a funnel to facilitate the capture of a falling marble 101.

As shown in FIGS. 2A, 2C and 2D, the top-to-side cube 300 has four tower bores 310. Each of the four tower bores 310 is located near, and oriented substantially parallel with, a vertical edge of the cube 300. The width of each tower bore 310 is approximately 3/16". The tower dowels 111+ have a width slightly smaller than that of the tower bores 310, so that the tower dowels 111+ may be easily inserted into the tower bores 310, and yet there is not so much play between the a dowel 111+ and a bore 310 that a cube 110+ will "wobble."Along the lower edge of the exit hole 320 and tangent with the exit hole 320 are two track bores 330 which are drilled along the normal of the side surface 332 of the cube 300. The track bores 330 have a depth of approximately ¼" and a diameter approximately equal to the diameter of the track dowels 115+, i.e., in the preferred embodiment they are approximately 3/16" in diameter.

A side-to-bottom cube 400 is shown in detail in FIGS. 3A–3D. The side-to-bottom cube 400 has a side entrance hole 415, and an exit hole 420 at the bottom of the cube 400. As shown in the cross-section of FIG. 3B, the entrance hole 415 is connected to the exit hole 420 by a channel 460 which has a horizontal portion 461, a vertical portion 462, and an inside corner 463. When the marble 101 enters the entrance hole 415, it will roll through the horizontal portion 461 of the channel 460. The motion of the marble 101 changes to vertical when the marble 101 passes the inside corner 463 of the channel 460 and begins to fall through the vertical portion 462 of the channel 460. The marble 101 then exits the cube 400 via the bottom hole 420. In contrast with the top-to-side cube 300 of FIG. 2B, the entrance hole 415 of the side-to-bottom cube 400 does not have a widened mouth.

Figure 3A:
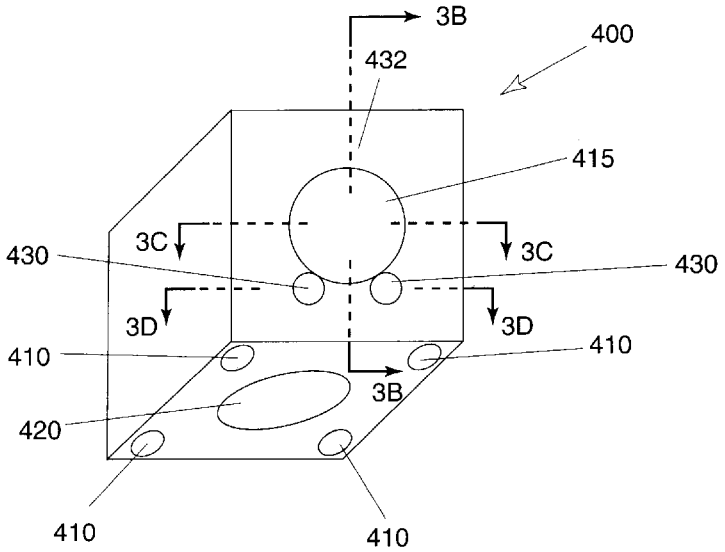
FIG. 3A is a perspective view of a side-to-bottom cube, i.e., a cube with a channel from a side surface to the bottom surface.
Figure 3D:
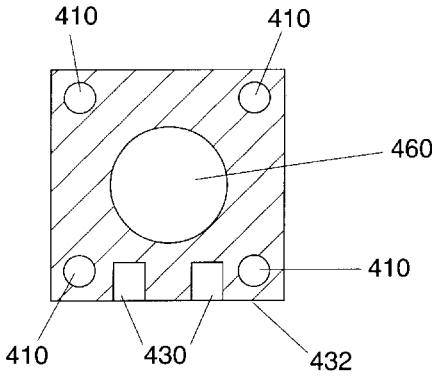
FIG. 3D shows a horizontal cross section through the track bores of the cube.
Figure 3B:
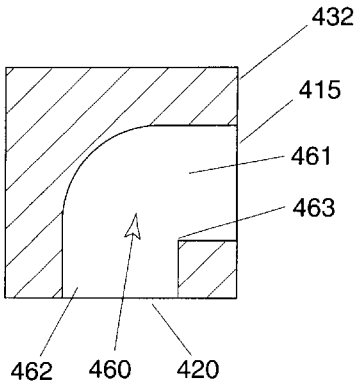
FIG. 3B shows a vertical cross section of the cube.
Figure 3C:
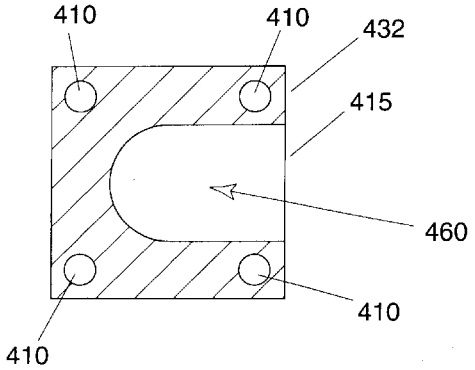
FIG. 3C shows a horizontal cross section through the entrance hole of the cube.

As shown in FIGS. 3A, 3C and 3D, the side-to-bottom cube 400 has four tower bores 410 located near and oriented substantially parallel with the vertical edges of the cube 400. Along the lower edge of and tangent with the side hole 420 are two track bores 430 which are drilled parallel to the normal of the side surface 432 of the cube 400.

A top-to-two-adjacent-sides cube 500 is shown in detail in FIGS. 4A–4D. The top-to-two-adjacent-sides cube 500 has an entrance hole 515 at the top of the cube 500, and two exit holes 520 on two adjacent sides 532 of the cube 500. As shown in the cross-section of FIG. 4B, the entrance hole 515 is connected to a side exit hole 520 by a channel 560 which is bifurcated. As shown in FIG. 4A, due to the symmetry of the cube 500 two cross-sectional cuts provide the cross-sectional view shown in FIG. 4B. When the marble 101 is dropped into the entrance hole 515, it rolls through the bifurcated channel 560, the vertical motion of the marble 101 changing to horizontal motion due to contact with a rounded rear surface 550, and exits from one of the side exit holes 520. As also shown in FIG. 4B, the mouth of the entrance hole 515 is widened by a counter-bore 540 to create a funnel to facilitate the capture of a falling marble 101.

As with the other types of cubes 110+, the top-to-two-adjacent-sides cube 500 has four tower bores 510 located near and oriented substantially parallel with the vertical edges of the cube 500, and along the lower edge of and tangent with each of the side holes 520 are two track bores 530 which are drilled parallel to the normal of the corresponding side surface 532 of the cube 500.

A top-to-two-opposite-sides cube 600 is shown in detail in FIGS. 5A–5D. The top-to-two-opposite-sides cube 600 has an entrance hole 615 at the top of the cube 600, and two exit holes 620 at opposite sides 632 of the cube 600. As shown in the cross-section of FIG. 5B, the entrance hole 615 is connected to the two side exit holes 620 by a bifurcated channel 660. When the marble 101 is dropped into the entrance hole 615, it will roll out of one of the exit holes 620 due to the slight declines from the center 661 to the outsides of the horizontal portion of the channel 660. As also shown in FIG. 5B, the mouth of the entrance hole 615 is widened by a counter-bore 640 to create a funnel to facilitate the capture of a falling marble 101.

As with the other types of cubes 110+, the top-to-two-opposite-sides cube 600 has four tower bores 610 located near and oriented substantially parallel with the vertical edges of the cube 600, and along the lower edge of and tangent with each of the side holes 620 are two track bores 630 which are drilled parallel to the normal of the corresponding side surface 632 of the cube 600.

A top-to-four-sides cube 1500 is shown in detail in FIGS. 14A–14D. The top-to-four-sides cube 1500 has an entrance hole 1515 at the top of the cube 1500, and exit holes 1520 at each of the four side faces 1532 of the cube 1500. The entrance hole 1515 is connected to the four side exit holes 1520 by a bifurcated channel 1560. Due to the four-fold symmetry of the cube 1500 about a vertical axis through the center of the entrance hole 1515, a vertical cross section through any of the four side exit holes 1520 provides the cross-sectional view of FIG. 14B. When the marble 101 is dropped into the entrance hole 1515, it will roll out of one of the exit holes 1520 due to the slight declines from the center 1561 to the outsides of the horizontal portion of the channel 1560. As also shown in FIG. 14B, the mouth of the entrance hole 1515 is widened by a counter-bore 1540 to create a funnel to facilitate the capture of a falling marble 101.

As with the other types of cubes 110+, the top-to-four-sides cube 1500 has four tower bores 1510 located near and oriented substantially parallel with the vertical edges of the cube 1500, and along the lower edge of and tangent with each of the side holes 1520 are two track bores 1530 which are drilled parallel to the normal of the corresponding side surface 1532 of the cube 1500.

A side-to-opposite-side cube 700 is shown in detail in FIGS. 6A–6D. The side-to-opposite-side cube 700 has two holes 720 on opposite sides 732 of the cube 700, each hole 720 functioning as either an entrance or an exit. As shown in the cross-section of FIG. 6B, the side holes 720 are connected by a horizontal channel 760. When the marble 101 enters a side hole 720, it rolls through the channel 760 and exits the cube 700 via the other side hole 720. As with the other types of cubes 110+, the side-to-opposite-side cube 700 has four tower bores 710 located near and oriented substantially parallel with the vertical edges of the cube 700, and along the lower edge of and tangent with each of the side holes 720 are two track bores 730.

A side-to-adjacent-side cube 800 is shown in detail in FIGS. 7A–7D. The side-to-adjacent-side cube 800 has two side holes 820 on adjacent side faces of the cube 800, each hole 820 functioning as either an entrance or an exit. As shown in the cross-section of FIG. 7B, the side holes 820 are connected by a channel 860 which bends at a right angle. When the marble 101 enters a side hole 820, it rolls through a straight portion 864 of the channel 860, contacts the curved rear surface 862 of the channel 860 and changes direction, and exits the other side hole 820 via the other straight portion 864 of the channel 860. As with the other type of cubes, the side-to-adjacent-side cube 800 has four tower bores 810, and tangent with and at the lower edge of each of the side holes 820 are two track bores 830.

Removing the upper half of the side-to-adjacent-side cube 800 provides a side-to-adjacent-side half cube 1600, as shown in detail in FIGS. 15A–15C. The side-to-adjacent-side half cube 1600 has two semicircular entrance/exits 1620 on adjacent side faces of the cube 1600 connected by an exposed right-angle groove 1660 across the top face 1634 of the half cube 1600. When the marble 101 enters a side entrance 1620, it rolls through a straight portion 864 of the groove 860, contacts the curved rear surface 1662 of the groove 1660 and changes direction, and exits the other side entrance/exit 1620 via the other straight portion 1664 of the groove 1660. Because the groove 1660 is exposed, the rolling of the marble 101 through the half cube 1600 can be viewed. As with the other type of cubes, the side-to-adjacent-side half cube 1600 has four tower bores 1610, and tangent with and at the lower edge of each of the side entrance/exits 1620 are two track bores 1630.

A four-sides-to-bottom cube 900 is shown in detail in FIGS. 8A–8D. The four-sides-to-bottom cube 900 has an entrance hole 915 on each of the four sides of the cube 900, and an exit hole 920 at the bottom of the cube 900. As shown in the cross-section of FIG. 8B (it should be noted that due to the symmetry of the cube 900, the both cross sections labeled as 8B in FIG. 8A provide the view of FIG. 8B), the entrance holes 915 are connected to the exit hole 920 by a channel 960 which has four horizontal portions 961, a vertical portion 962, and inside comers 963. When the marble 101 enters an entrance hole 915, it will roll through that horizontal portion 961 of the channel 960. The motion of the marble 101 changes to vertical when the marble 101 passes the corresponding inside corner 963 of the channel 960 and begins to fall through the vertical portion 962 of the channel 960. The marble 101 then exits the cube 900 via the exit hole 920. As with the other type of cubes, the four-sides-to-bottom cube 900 has four tower bores 910, and two track bores 930 at the base of each of the side holes 915.

An end cube 1000 is shown in perspective in FIGS. 9A and a horizontal cross-section is shown in FIG. 9B. The end cube 1000 does not have a channel for the marble to pass through. The end cube 1000 has four vertical cylindrical bores 1010 and two adjacent side faces of the cube 1000 have two track bores 1030. In an alternate embodiment, the end cube 1000 has two track bores 1030 on each side face.

It may be noted that if the side-to-bottom cube 400 of FIGS. 3A–3D had a counterbore to widen the mouth of the entrance hole 415 it would be identical to the top-to-side cube 300 of FIGS. 2A–2D except for the placement of the track bores 415 and 315, respectively. Or conversely, if the top-to-side cube 300 of FIGS. 2A–2D did not have a counterbore 340 to widen the mouth of the entrance hole 315 it would be identical to the side-to-bottom cube 400 of FIGS. 3A–3D except for the placement of the track bores 315 and 415, respectively. Therefore, as shown in FIGS. 10A–10E, a single cube 1100 can function as both a top-to-side cube and a side-to-bottom cube if the side hole 1120 has track bores 1130 on the edge of the side hole 1120 farthest from the top/bottom hole 1115, and track bores 1131 on the edge of the side hole 1120 nearest the top/bottom hole 1115. This type of cube 1100 is called a top-to-side/side-to-bottom cube.

As shown in the cross-section of FIG. 10B, the top/bottom hole 1115 is connected to the side hole 1120 by a channel 1160. When the cube 1100 functions as a top-to-side cube and the marble 101 is dropped into the hole 1115 having a counterbore 1140, it will roll through the channel 1160, the vertical motion of the marble 101 changing to horizontal motion due to contact with a rounded rear surface 1150, and exit from the side hole 1120. If track dowels 115+ are inserted in the track bores 1130, then the marble 101 will roll along these track dowels 115+. As shown in FIG. 10B, the mouth of the entrance hole 1115 is widened by a counterbore 1140 to create a funnel to facilitate the capture of a falling marble 101.

When the top-to-side/side-to-bottom cube 1100 functions as a side-to-bottom cube, the marble 101 rolls along track dowels 115+ inserted into the track bores 1131 and enters the side hole 1120. The marble 101 will then roll through the horizontal portion 1161 of the channel 1160. The motion of the marble 101 changes to vertical when the marble 101 passes the inside corner 1163 of the channel 1160 and falls through the vertical portion 1162 of the channel 1160. The marble 101 then exits the cube 1100 via the hole 1115 which is now at the bottom of the cube 1100.

Clearly, an advantage of the top-to-side/side-to-bottom cube 1100 is that this cube 1100 provides the functions of two cubes. However, the hole 1115 with the counterbore 1140, while serving well in catching falling marbles 101, does not direct marbles as accurately as the side-to-bottom cube 400 when functioning in this capacity due to the widened mouth of the bottom exit hole 1115.

Figure 11A:
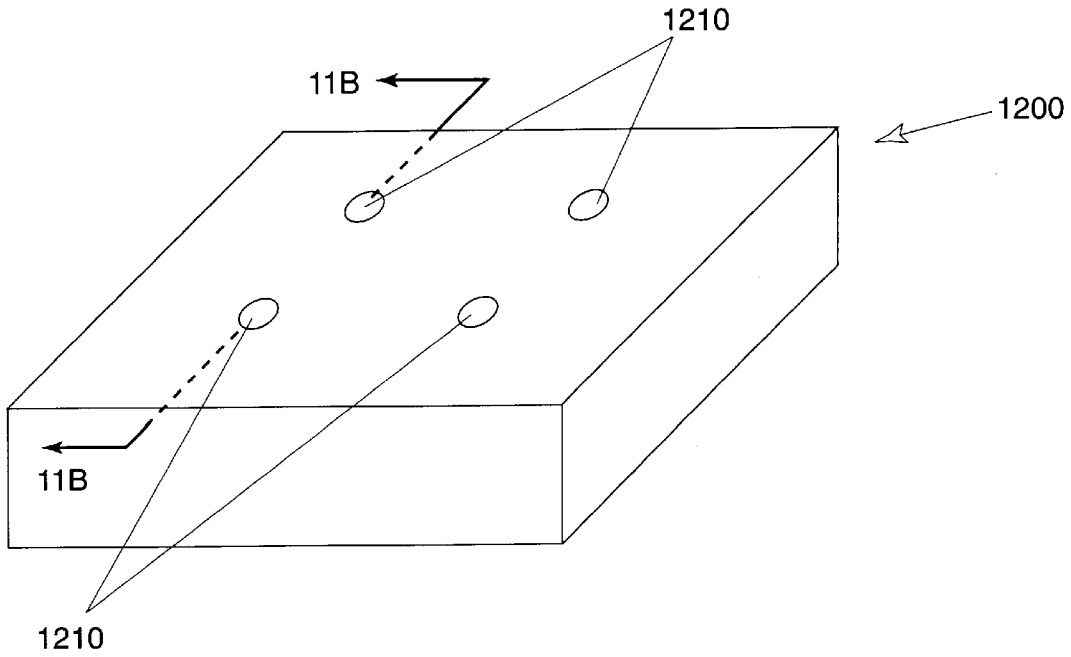
FIG. 11A is a perspective view of a base block.
Figure 11B:
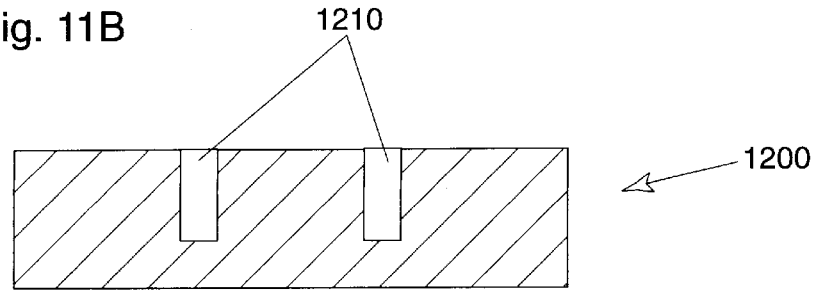
FIG. 11B shows a vertical cross section of the base block through two tower bores.

A base block 1200 is shown in perspective in FIG. 11A, and a cross-section through two tower bores is shown in FIG. 11B. The base block 1200 has four tower bores 1210 arranged in a square centered in the block 1200, the edges of the square being aligned with the edges of the block 1200. The tower bores 1210 do not reach the bottom surface of the base block 1200.

The marble 101 of the preferred embodiment of the present invention has a diameter of ⅝". This diameter is an industry standard for glass marbles. The diameter of the marble 101 is to be considered a fundamental dimension, in that if the marble size is increased other dimensions will have to be increased by approximately the same ratio. Glass marbles with a diameter of ⅝" have sufficient mass and therefore acquire sufficient momentum to be relatively unaffected by imperfections in the interior channels of the cubes 110+, imperfections on the surfaces of the track dowels 115+, or slight height increases when rolling from a pair of track dowels 115+ into a cube 110+ or from a cube 110+ onto a pair of track dowels 115+. Generally, the size of marbles from a single manufacturer may vary by as much as 0.040".

In a first preferred embodiment all the components 110+, 111+, 112+ and 115+ (other than the marble 101) are fabricated from wood to provide an aesthetically pleasing appearance and feel. In a second preferred embodiment all the components 110+, 111+, 112+ and 115+ (other than the marble 101) are fabricated from plastic to provide a low cost construction set. In the preferred embodiment the tower dowels 111+ and the track dowels 115+ have diameters of approximately 3/16". This diameter is another fundamental dimension of the present invention, in that if the size of the dowels 111+ and 115+ is increased, other dimensions (such as the tower bores and the track bores) must be increased by approximately the same ratio. The tolerance of the diameter of the tower dowels 111+ is approximately ±0.008" to insure that the tower dowels 111+ can be easily inserted into the tower bores in the cubes 110+ and base blocks 1200, and yet (i) there is sufficient friction to prevent the tower dowels 111+ from being pulled out of a base block 1200 when moving a cube 110+ up the tower dowels 111+, and (ii) there is not so much play between the tower dowels 111+ and the tower bores that the cubes 110+ will "wobble" or the tower dowels 111+ will not extend vertically from the base blocks 1200. Similarly, the tolerance of the diameter of the track dowels 115+ is approximately ±0.008" to insure that the track dowels 115+ can be easily inserted into the track bores, and yet there is sufficient play to allow the track dowels 115+ to be angled slightly up or down to provide a downwards slanting track for the marble 101.

If the interior channels 360+ in the cubes 110+ are too narrow the marble 101 will not be able to roll freely through the channels 360+. Because the track bores 330+ must be separated by a distance somewhat less that the diameter of the marble 101, if the channels 360+ are too wide the marble 101 will not reliably roll onto the track dowels 115+. In the preferred embodiment the interior channels have a diameter 1.05 to 1.6 times the diameter of the marble 101, and more preferably 1.1 to 1.4 times the diameter of the marble 101, and most preferably 1.2 times the diameter of the marble 101. In particular, in the preferred embodiment with the dimension of the marble 101 as specified above the channels 360+ have a diameter of ¾".

The tower bores 310+ in the cubes 110+ must be wide enough to allow a child to slide the tower dowels 111+ into the tower dowels 111+, and pull the tower dowels 111+ out of the tower bores 310+, yet not so wide that orientation of a cube 110+ has any play. Preferably, the tower bores 310+ have a diameter 0.007" to 0.040" larger than the tower dowels 111+, more preferably a diameter 0.010" to 0.030" larger than the tower dowels 111+, and most preferably a diameter 0.015" to 0.020" larger than the tower dowels 111+.

In the preferred embodiment the cubes 110+ must be large enough that the tower bores 310+ are inset from the sides of the cube 110+ by a distance s of at least 1/16", more preferably ⅛", and most preferably 5/32", and the distance s also separates the tower bores 310+ from the interior channels 360+, to insure that the wood does not splinter in the process of drilling the tower bores 310+ and the interior channels 360+. (This relationship is expressed algebraically in Table 1 below.) With the dimensions specified above, the edges of the cubes 110+ of the preferred embodiment have a length of 1.5". However, if the cubes 110+ are fabricated of plastic, the distance between the tower bores 310+ and the interior channels 360+ can be substantially smaller since the plastic parts are molded rather than drilled.

The tower bores 310+ are drilled near to and parallel with each vertical edge of the each cube 110+. The central longitudinal axis of each tower bore 310+ is separated from the central longitudinal axis of the two nearest tower bores 310+ by 1.125", i.e., the central longitudinal axes of the tower bores 310+ (which have an interior radius of 0.09375" as mentioned above) are 0.1875" from the two nearest exterior surfaces of the cube 110+. It would be problematic to have the tower bores 310+ substantially closer to the sides of the cubes 110+ in mass production since the wood would be likely to crack or splinter during the drilling of the tower bores 310+. However, if the cubes 110+ are fabricated of plastic, the distance between the tower bores 310+ and the sides of the cubes 110+ can be substantially smaller since plastic parts are molded.

The depth of the track bores 330+ must be small enough and the diameter of the track bores 330+ must be large enough that track dowels 115+ extending therefrom may be given a slight upwards or downwards slant. However, the depth of the track bores 330+ must be great enough and the diameter of the track bores 330+ must be close enough to that of the track dowels 115+ that a track dowel 115+ inserted into a track bore 330+ will not fall out from its own weight. In the preferred embodiment the track dowels 115+ can be given an upwards or downwards slant angle Θ of 3° to 10°, and the track bores 330+ have a depth D which is 33% to 100% greater than the diameter of the track dowels 115+. The relation between the slant angle Θ, the depth D of a track bore, the diameter y of a track dowel, and the diameter X of the track bore is given by $$D \tan\Theta + y \cos\Theta = X.$$

In particular, in the preferred embodiment with the track dowel diameter Y of 3/16" as specified above, and the track bores have a depth of 0.25" to 0.375". For track bores with a depth D of 0.25", the track bores have a diameter X of 0.20" to 0.23" to provide a slant angle Θ between 3° to 10°. For track bores with a depth D of 0.375", the track bores have a diameter X of 0.21" to 0.25" to provide a slant angle Θ between 3° to 10°.

Ideally, the track bores 330+ are just tangent with the horizontal portion of the channel 360+ so that the marble 101 can roll smoothly into and out of the channel 360+. In practice, in the preferred embodiment of the present invention with the dimensions as specified above the track bores 330+ should not protrude more than 1/32" into the channel 360+ and should not be more than 1/32" away from the channel 360+, and more preferably the track bores 330+ should not protrude more than 1/64" into the channel 360+, and should not be more than 1/64" away from the channel 360+.

Figure 13:
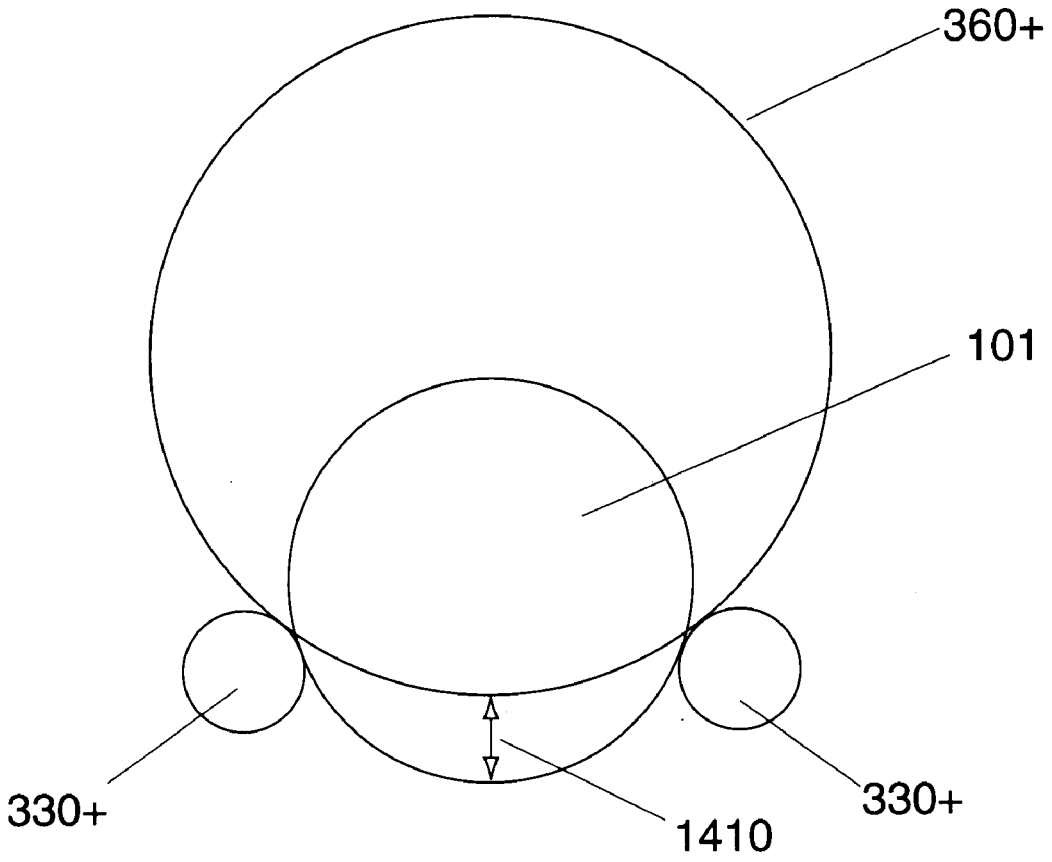
FIG. 13 is a diagram illustrating how the bottom of the marble is located below the bottom of a channel when the marble rests on track dowels extending from track bores.

The track bores 330+ must not be so closely spaced that transverse momentum of the marble 101 as it rolls onto the track dowels 115+ might cause the marble 101 to roll off the track dowels 115+. However, as the distance between the track bores 330+ is increased, the rolling of the marble 101 into and out of the channel 360+ becomes less smooth. As illustrated in FIG. 13, since the marble 101 has a diameter which is smaller than that of the channel 360+ (the difference in the diameters of the marble 101 and channel 360+ is exaggerated in FIG. 13 for purposes of illustration), and both the channel 360+ and the marble 101 are tangent to the track bores 330+, the bottom of the marble 101 is offset from the bottom of the channel 360+ by an offset distance 1410 when the marble 101 rests on track dowels 115+ (not shown in FIG. 13). Clearly, as the distance between the track bores 330+ is increased, this offset distance 1410 increases, and the rolling of the marble 101 into the channel 360+ becomes increasingly impeded. In the preferred embodiment, the centers of the track bores 330+ are separated by a distance which is between 50% and 90% of the diameter of the marble 101, more preferably the centers of the track bores 330+ are separated by a distance which is between 70% and 85% of the diameter of the marble 101, and most preferably the centers of the track bores 330+ are separated by a distance which is approximately 80% of the diameter of the marble 101. In particular, with the dimensions as specified above, in the preferred embodiment the track bores 330+ are separated by a distance of 0.5".

In an alternate embodiment of the present invention the track bores 330+ do extend somewhat into the channel 360+. This allows the offset distance 1410 of FIG. 13 to be reduced to zero. However, although this makes the rolling of the marble 101 into the channel 360+ smoother, the protrusion of the track dowels 115+ into the channel 360+ will tend to impede the rolling of the marble 101 out of the channel 360+. However, it should be noted that generally a marble 101 rolling into a channel 360+ will have more momentum than a marble 101 rolling out of a channel 360+, especially when the channel 360+ has a right angle turn so that the marble 101 must collide with a wall of the channel 360+. Therefore, it is more important that the rolling of a marble 101 out of a channel 360+ be smooth, than the rolling of a marble 101 into a channel 360+ be smooth.

The base blocks 1200 must have sufficient mass and a large enough plan area (i.e., the area of a horizontal cross section) to provide stability to the towers of tower dowels 111+ and cubes 110+. In the preferred embodiment the base blocks have a plan area at least twice the plan area of the cubes 110+, and more preferably at least three times the plan area of the cubes 110+. In the preferred embodiment the base blocks 1200 have a mass at least as great as a cube 110+. In particular, in the preferred embodiment with the dimensions as specified above each base block 1200 has a depth of ¾" and the top square face has an edge length of 3", i.e., the plan area is four times the plan area of a cube 110+ and the mass is approximately twice the mass of a cube 110+. In an alternate embodiment, the base blocks 1200 are made of a more dense material than the cubes 110+, thereby enhancing the weight difference between the base blocks 1200 and cubes 110+, or allowing the base blocks 1200 to have less volume while maintaining the same weight.

In a base block 1220 each tower bore 1210 is separated from the two nearest tower bores 1210 by the same distance as the tower bores 310+ in the cubes 110+, i.e., 1.125", so tower dowels 111+ extending from a base block 1200 can pass through the tower bores 310+ in the cubes 110+. The tower bores 1210 are deep enough to minimize lateral motion of a tower dowel 111+ extending therefrom, without being so deep that the wood between the bottom of the bore 1210 and the bottom surface of the block 1200 is likely to break. In the preferred embodiment the tower bores 1210 have a depth of ⅝", leaving ⅛" between the bottom of the bores 1210 and the bottom surface of the base block 1200. The tower bores 1210 in a base block 1200 should fit the tower dowels 111+ sufficiently snugly that a cube 110+ can be moved up the tower dowels 111+ without pulling the tower dowels 111+ out of the base block 1200+. However, the diameter of the tower bores 1210 should be sufficiently larger than the diameter of the tower dowels 111+ that a child can easily insert and remove a tower dowel 111+ from a tower bore 1210. In the preferred embodiment the diameter of the tower bores 1210 is approximately 0.002" to 0.015" larger than the diameter of the tower dowels 111+, more preferably 0.003" to 0.010" larger than the diameter of the tower dowels 111+, and most preferably 0.005" to 0.007" larger than the diameter of the tower dowels 111+.

The larger the diameter of the counterbore 340+, the farther a marble 101 can fall, for instance from the bottom exit hole of another cube 110+, and still reliably enter the top entrance hole of the counterbored cube 110+. In the preferred embodiment the counterbores 340+ have a diameter of 1". However, since even for wood cubes 110+ the counterbore 340+ can extend to the outsides of the tower bores 310+ without causing fabrication problems, the counterbores 340+ may have diameters as large as 1.25", with the dimensions of the cubes 110+ and tower bores 310+ as specified above.

In the preferred embodiment of the present invention, the center of each cube 110+ is located on a square grid defined by $(n_x e_x + n_y e_y)$, where $n_x$ and $n_y$ are integers and $e_x$ and $e_y$ are basis vectors in the x and y directions. Therefore, if the shortest track dowel length is $r_1$, the side length of the cubes 110+ is z, and the depth of the track bores 330+ is q, the basis vectors $e_x$ and $e_y$ have lengths of $(r_1+z-2q)$. The length $r_2$ of the next longer size of track dowel 115+ must then satisfy $$r_2+z-2q=2(r_1+z-2q),$$

so $$r_2=2r_1+z-2q,$$

and in general $$r_n=nr_1+(n-1)z-2(n-1)q,$$

where $r_n$ is the length of the $n^{th}$ shortest track dowel 115+. In the preferred embodiment of the present invention the cubes 110+ have a side length of 1.5", the track bores 330+ have a depth of ¼", and the shortest track dowels 115+ have a length of 5". The preferred embodiment of the present invention has three lengths of track dowels, so according to the above relations the intermediate length track dowels 115+ have a length of 11", and the longest track dowels 115+ have a length of 17".

Some of the approximate relationships between the dimensions of the components of the construction kit as discussed above are summarized in Table 1 below, given that the width y of the track dowels 115+ is the same as that of the tower dowels 111.

TABLE 1

Relationships between Dimensions

| | Marble size (x) | Dowel Diameter (y) | Cube edge length (z) |
|---|---|---|---|
| Base block tower bore diameter | — | y + 0.005" to y + 0.007" | — |
| Cube tower bore diameter | — | y + 0.015" to y + 0.020" | — |
| Track bore depth (q) | — | 1.33 * y to 2.0 * y | — |
| Distance between track bores | ≈0.8 * x | — | — |
| Marble channel diameter | >1.2 * x | — | — |
| Cube edge length (s = min. distance between bores) | >4 * s + 2 * y + 1.2 * x | | z |
| Base block top face edge length | — | — | >2 * z |
| $n^{th}$ track dowel length ($r_1$ = shortest track dowel length) (q = track bore depth) | | | $n r_1 + (n - 1)(z - 2q)$ |

The four tower bores 310+ in each cube 100+ and base block 112+ are manufactured by drilling all four tower bores 310+ simultaneously using a four-spindle bit. Similarly, pairs of track bores 330+ below each horizontally-oriented channel entrance or exit are drilled simultaneously using a two-spindle bit. In an alternate embodiment, both track bores 330+ below a horizontally-oriented channel entrance or exit and a central alignment bore for the channel are drilled simultaneously using a three-spindle bit. The central alignment bore provides a guide for the drilling of the channel 360+.

Figure 16A:
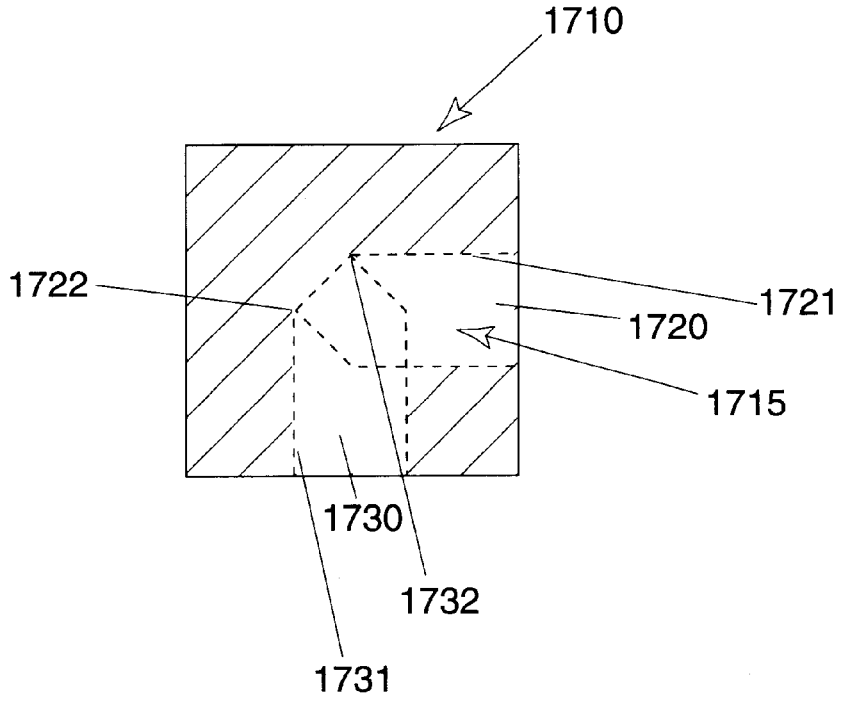
FIG. 16A illustrates the formation of a channel having a right-angle turn using two drill bits.

According to the preferred embodiment of the present invention, the marble channels are drilled using a bit with a 45° tip (i.e., the interior angle of the conical tip of the bit is 90°), and six channels 360+ in six cubes 110+ are drilled simultaneously using a six-spindle bit. Shown in FIG. 16A is a cube 1710 with a channel 1715 having a right angle turn, a first drill bit 1720 shown in dashed outline directed upwards on the page, and a second drill bit 1730 shown in dotted outline directed towards the left. If the cube 1710 has a side length z and the drill bits have a diameter p, then the tip 1722 of left-directed drill bit 1720 reaches the far side wall 1731 of the channel 1715 drilled by the upwards-directed drill bit 1730, and the tip 1732 of the upwards-directed drill bit 1730 reaches the far side wall 1721 of the channel 1715 drilled by left-directed drill bit 1720 when a plunge depth of (z+p)/2 is used. Whereas cusps in the channel 1715 will not inhibit the rolling of the marble 101 through the channel 1715 if either section of the channel 1715 is vertically oriented, if both sections of the channel 1715 are horizontally oriented (as is the case with the side-to-adjacent-side cube 800 of FIGS. 7A–7D) then it is necessary to smooth the lower surface of the channel 1715 using a spherical-head rotary rasp. In the preferred embodiment the diameter of the rotary rasp is between 75% to 95% of the channel diameters, and is more preferrably approximately 85% of the channel diameter P. According to the above-specified dimensions for the preferred embodiment (z=1.5" and p=¾"), the plunge depth is ⅝" and the diameter of the spherical-head rotary rasp is ⅝". (It should be noted that rounded wall contours as shown in the cross-sectional views of FIGS. 2B, 2C, 3B, 3C, 4B, 4C, 7B, 7C, 10B, 10C, 15A and 15C may also be formed using a spherical-head rotary rasp.)

Figure 16B:
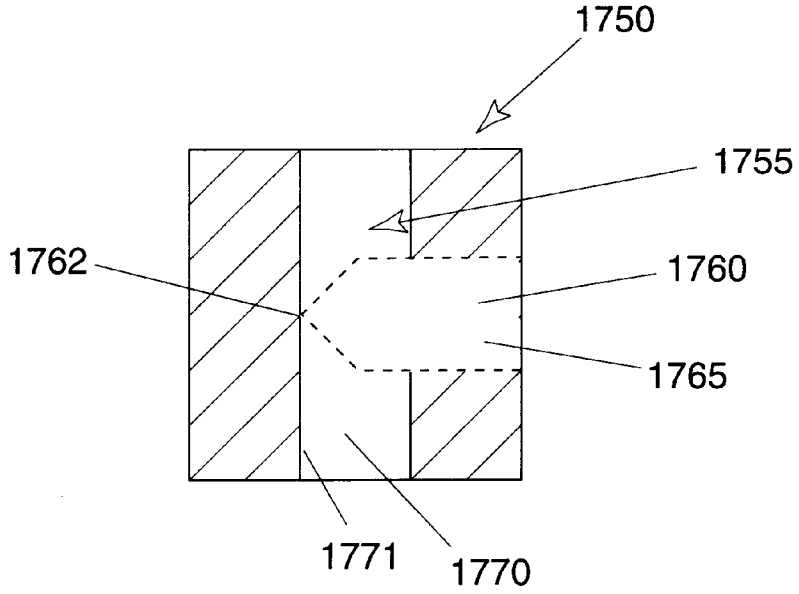
FIG. 16B illustrates the use of a drill bit to form a section of a channel connecting to a through-bore.

Shown in FIG. 16B is a cube 1750 with a channel 1755 having a linear through-bore 1770 and a second bore 1765 with a drill bit 1760 shown in dashed outline in the second bore 1765. The second bore 1765 meets the linear through-bore 1770 at a right angle. Again, if the cube 1750 has a side length z and the drill bits have a diameter p, then the tip 1762 of drill bit 1760 reaches the far side wall 1771 of the channel 1755 (and the connection between the two sections 1765 and 1770 of the channel 1755 is made widest) when a plunge depth of (z+p)/2 is used. For this geometry of channel 1755 it is not necessary to smooth the channel 1775 using a rotary rasp since it is expected that the marble 101 will only be making a right-angle turn through the channel 1755 if section 1765 or section 1770 of the channel 1755 is vertically oriented. (If both sections 1765 and 1770 of the channel 1755 are horizontally oriented then cusps in the lower surface of the channel 1755 will not affect the motion of a marble 101 rolling straight through the through-bore 1770, and having a marble 101 enter through section 1765 is to be avoided since its collision with the far wall 1771 of the through-bore 1770 will cause it to come to rest inside the block 1750 regardless of any cusps.) According to the above specified dimensions for the preferred embodiment (z=1.5" and p=¾"), the plunge depth is again ⅝".

As mentioned above and shown in FIG. 5B, the horizontal portion of the channel 660 of the top-to-two-adjacent-sides cube 600 has a slight decline from the center 661 to the outside of the horizontal portion of the channel 660, so that a marble 101 falling through the top entrance 615 will roll out of the cube 600 after striking the bottom of the channel 660 at the center point 661. Similarly, as shown in FIG. 14B, the horizontal portion of the channel 1560 of the top-to-four-sides cube 1500 has a slight decline from the center 1561 to the outside of the horizontal portion of the channel 1560, so that a marble 101 falling through the top entrance 1515 will roll out of the cube 1500 after striking the bottom of the channel 1560 at the center point 1561. Therefore the horizontal portions of the channels 660 and 1560 of the top-to-two-adjacent-sides cube 600 and top-to-four-sides cube 1500 are drilled with the drill bit having a slight upwards slant.

Although the above description contains many specificities, these should not be construed as limiting the scope of the invention, but as merely providing illustrations of some of the preferred embodiments of this invention. Many variations are possible and are to be considered within the scope of the present invention. For instance, the dowels, cubes and base blocks may be made of other materials such as metal or plastic. If made of plastic the components could color coded at no additional expense, or could be translucent or transparent. Furthermore, if the cubes and tower dowels are made of plastic the tolerances can be tightly controlled, and rubber bands would therefore not be necessary to prevent the cubes from slipping down the tower dowels. Also, if constructed of plastic the track bores, track dowels and horizontal portions of the channels could be formed such that the marble would roll smoothly into and out of the channels. Other variations include: a ball or the like may be substituted for the marble; objects which are not spherical can be made to travel down the marble track; cubes may rest on the floor or on objects such as books or furniture, rather than being supported by tower dowels; household paraphernalia can be incorporated into the marble track; tower dowels may rest on the floor rather than being inserted into a base block; a base block may have more than four tower bores so as to be able to support multiple towers; the track dowels and the tower dowels may have different widths and/or lengths; the shortest track dowel may have a different length while the other track dowels have lengths which are related to the shortest length track dowels as specified above; there may be more than or less than three lengths of track dowels; the cross-sections of the track dowels and tower dowels may have other shapes; sides of the cubes which do not have a channel entrance/exit may have track dowel holes to provide the additional functionality of an end cube; the end cube may include an internally-located bell or some other type of electronic or mechanical sound generator so as to produce a sound when the marble strikes the end cube; the end cube may be hollow so that the sound of the marble striking the end cube will be amplified; the marble may be made of other materials, such as metal; a cube may have tower bores on the top and bottom surfaces which do not pass all the way through the cube; cubes may have less than four tower bores, for instance a cube may have two tower bores located near to and parallel with opposite edges; structures even higher than those shown in FIG. 1 may be constructed by positioning a cube at the top of a set of four tower dowels so that the tower dowels extend only partially into the tower bores, and inserting another set of four tower dowels into the top portions of the tower bores of the cube; the blocks which have been described above as cubes may have other exterior shapes; cubes with other combinations of entrance and exit holes are possible, such as a top-to-three-sides cube, or a cube with three side entrances and no top and bottom holes, or a cube with entrance on the top and all four side faces; a single large base block having a grid of groups of four tower bores may be used in place of a plurality of base blocks each having only four tower bores; the tower bores may be slightly curved or drilled off-vertical to increase the friction with the tower dowels, so that rubber bands are not necessary to stabilize the positions of cubes; the track bores need not be drilled along the normal of the face of the cube, although this does allow a marble to both enter and exit from the hole to the channel meeting the track at these track bores; the portions of the channels which have been described as horizontal may be modified to have an upwards or downwards slant, for instance the channel near the exit hole of the top-to-side cube may have a downwards slant; rubber bands may be placed around cubes which have side holes to block the side holes so such cubes can be used as end cubes; the track bores may be shaped as slots rather than cylindrical bores so the track dowels may be slanted at a greater range of angles; a marble track constructed with the components of the present invention may have converging paths; a marble track constructed with the components of the present invention may include a pair of track dowels which are inserted into track bores of a cube at only one end thereof, and below the free end of the track dowels there may be another portion of the marble track, such as another pair of track dowels, so that the marble will roll off the free ends of the track dowels onto the other section of the marble track and continue rolling, possibly in a different direction; the upper half of any type of full cube may be removed to provide a half cube with an exposed channel; etc. Many other variations are also to be considered within the scope of the present invention. Thus the scope of the invention should be determined not by the examples given herein, but rather by the appended claims and their legal equivalents.

What is claimed is:

1. A set of components for constructing a track for a sphere to roll down, comprising:

a plurality of tower/track dowels; and a plurality of cubes, each of said cubes having a channel through which said sphere can pass, said channel extending between a first hole at a first surface and a second hole at a second surface, a first pair of track bores into which said tower/track dowels may be removably inserted, located below said first hole if said first hole has a horizontal orientation when said cubes are oriented for use in said track, a second pair of track bores bores into which said tower/track dowels may be removably inserted, located below said second hole if said second hole has a horizontal orientation when said cubes are oriented for use in said track, and a number of cube tower bores through which said tower/track dowels may be removably inserted.

2. The construction set of claim 1 wherein said first and second surfaces of a first one of said cubes are opposing, so a first longitudinal axis of said channel near said first hole of said first one of said cubes is parallel to a second longitudinal axis of said channel near said second hole of said first one of said cubes.

3. The construction set of claim 1 wherein said first and second surfaces of a first one of said cubes are adjacent, so a first longitudinal axis of said channel near said first hole of said first one of said cubes is orthogonal to a second longitudinal axis of said channel near said second hole of said first one of said cubes.

4. The construction set of claim 1 wherein one of said first pairs of track bores in one of said cubes are approximately tangent with said first hole of said one of said cubes.

5. The construction set of claim 4 wherein first longitudinal axes of said one of said first pair of track bores are normal to said first surface of said one of said cubes.

6. The construction set of claim 4 wherein said second pair of track bores in said one of said cubes are approximately tangent with said second hole of said one of said cubes.

7. The construction set of claim 6 wherein said second pair of track bores in said one of said cubes are normal to said second surface of said one of said cubes.

8. The construction set of claim 1 wherein said number of cube tower bores in each of said cubes is four.

9. The construction set of claim 1 further including a plurality of base blocks, each of said base blocks having a first set of base block tower bores with a cardinality and arrangement the same as said cube tower bores.

10. The construction set of claim 1 further including an end cube having a first end cube side face with a pair of end cube track bores, so that if said sphere reaches said end cube by rolling along a pair of said tower/track dowels inserted into said pair of end cube track bores, said sphere will collide with said first end cube side face and come to rest.

11. The construction set of claim 10 wherein said end cube has an end cube channel between a second face thereof and a third face thereof through which said sphere can pass.

12. The set of components of claim 1 wherein friction between said tower bores and said tower/track dowels is sufficient to hold one of said cubes in a fixed position when a group of said tower/track dowels are inserted through said tower bores in said one of said cubes, and said group of said tower/track dowels are aligned vertically.

13. A set of components for constructing a track for a sphere to roll down, comprising:

a plurality of tower dowels;

a plurality of track dowels;

a plurality of cubes, each of said cubes having a channel through which said sphere can pass, said channel extending between a first hole at a first surface and a second hole at a second surface, a first pair of track bores into which said track dowels may be removably inserted, located below said first hole if said first hole has a horizontal orientation when said cubes are oriented for use in said track, a second pair of track bores bores into which said track dowels may be removably inserted, located below said second hole if said second hole has a horizontal orientation when said cubes are oriented for use in said track, and a number of cube tower bores through which said tower dowels may be removably inserted; and wherein one of said channels in one of said cubes bifurcates at a point obscured from view to a third hole at a third surface.

14. The construction set of claim 13 wherein below said third hole at said third surface is located above a third pair of track bores if said third hole has a horizontal orientation when said cubes are oriented for use in said track.

15. A set of components for constructing a track for a sphere to roll down, comprising:

a plurality of tower dowels;

a plurality of track dowels;

a plurality of cubes, each of said cubes having a channel through which said sphere can pass, said channel extending between a first hole at a first surface and a second hole at a second surface, a first pair of track bores into which said track dowels may be removably inserted, located below said first hole if said first hole has a horizontal orientation when said cubes are oriented for use in said track, a second pair of track bores bores into which said track dowels may be removably inserted, located below said second hole if said second hole has a horizontal orientation when said cubes are oriented for use in said track, and a number of cube tower bores through which said tower dowels may be removably inserted; and a band made of an elastomeric material, placement of said band around a group of said tower dowels passing through said tower bores of one of said cubes inducing increased friction between said group of said tower dowels and said tower bores of said one of said cubes so as to stabilize a position of said one of said cubes on said group of said tower dowels.

16. A set of components for constructing a track for a sphere of sphere diameter x to roll down, comprising:

a first plurality of cubes of edge length z, each of said cubes having a channel through which said sphere can pass, said channel extending between a first hole at a first surface and a second hole at a second surface, a first pair of track bores of track bore depth q located below said entrance hole if said entrance hole has a horizontal orientation when said cubes are oriented for use in said track, a second pair of track bores of track bore depth q located below said exit hole if said exit hole has a horizontal orientation when said cubes are oriented for use in said track, and a number of cube tower bores; and a second plurality of tower dowels of dowel diameter y insertable through said cube tower bores;

a third plurality of track dowels of said dowel diameter y of a first length $r_1$ insertable in said track bores, a fourth plurality of track dowels of said dowel diameter y of a second length $r_n$ insertable in said track bore, where $$r_n = nr_1 + (n-1)(z-2q),$$

and n is an integer, so that centers of said cubes connected by said track dowels of said first length and said track dowels of said second length are located at points on a square grid.

17. The construction set of claim 16 wherein a diameter of said channels in said cubes is 1.05 to 1.6 times said sphere diameter x.

18. The construction set of claim 16 wherein a diameter of said channels in said cubes is approximately 1.2 times said sphere diameter x.

19. The construction set of claim 16 wherein said edge length z is greater than twice said dowel diameter y plus a diameter of said channels in said cubes plus four times a minimum wall thickness s.

20. The construction set of claim 16 wherein said minimum wall thickness s is greater than 1/16".

21. The construction set of claim 16 wherein said minimum wall thickness s is approximately 5/32".

22. The construction set of claim 16 wherein said depth q of said track bores is approximately 1.3 to 2.0 times said dowel diameter y.

23. The construction set of claim 16 wherein one of said track dowels inserted into one of said track bores is limited to an angle of 10° from a longitudinal axis of said one of said track bores.

24. The construction set of claim 16 wherein said tower bores in said cubes have a tower bore diameter which is 0.007" to 0.040" greater than said dowel diameter y.

25. The construction set of claim 16 wherein said tower bores in said cubes have a tower bore diameter which is 0.010" to 0.030" greater than said dowel diameter y.

26. The construction set of claim 16 wherein said tower bores in said cubes have a tower bore diameter which is 0.015" to 0.020" greater than said dowel diameter y.

27. The construction set of claim 16 wherein centers of said first pair of track bores and said second pair of track bores are separated by 50% to 90% of said sphere diameter x.

28. The construction set of claim 16 wherein centers of said first pair of track bores and said second pair of track bores are separated by 70% to 85% of said sphere diameter x.

29. The construction set of claim 16 wherein centers of said first pair of track bores and said second pair of track bores are separated by approximately 80% of said sphere diameter x.

30. The construction set of claim 16 further including a plurality of base blocks each with a base block mass at least as great as a mass of each of said cubes, each of said base blocks having a base block plan area at least twice as great as a plan area of each of said cubes, and each of said base blocks having a first set of base block tower bores with a cardinality and arrangement the same as said cube tower bores.

31. The construction set of claim 30 wherein said base block tower bores are approximately 0.005" to 0.007" larger than said dowel diameter y.

32. A method for fabricating a block with a channel for a sphere to roll through including a first bore and a second bore perpendicular to said first bore, comprising the steps of:

drilling at a first point of entrance on said block along a first direction with a first bit having a first cylindrical section of a first diameter, said first bit having a first conical tip with a first interior tip angle of approximately 90°, to produce said first bore having a first cylindrical side wall and a first conical terminating wall meeting said first cylindrical side wall at a first circular wall junction, said first conical terminating wall having a first conical terminating point;

drilling said second bore at a second point of entrance on said block along a second direction orthogonal to said first direction with a second bit having a second cylindrical section having a second diameter, and a second conical tip with a second interior tip angle of approximately 90°, said second conical tip meeting said second cylindrical section at a second circular junction, to a depth such that said second conical tip approximately coincides with said first circular wall junction at a first location on said first circular wall junction farthest from said second point of entrance, and said first conical terminating point approximately coincides with said second circular junction at a second location on said second circular junction farthest from said first point of entrance; and smoothing a bore junction where said first and second bores meet using a spherical-head rotary rasp having a third diameter less than said first and second diameters.

33. The method of claim 32 wherein said first and second diameters are equal.

34. The method of claim 32 wherein said third diameter is 75% to 95% of said first and second diameters.

35. The method of claim 32 wherein said first and second bits are the same.

36. The method of claim 32 wherein said block is wood.

37. The method of claim 36 wherein said block is a rectangular parallelepiped.

* * * * *